United States Patent [19]

Sakanoue et al.

[11] Patent Number: 4,842,994

[45] Date of Patent: Jun. 27, 1989

[54] MATERIAL COMPRISING A NOVEL BLEACH ACCELERATOR-RELEASING COUPLER

[75] Inventors: Kei Sakanoue; Seiji Ichijima, both of Kanagawa, Japan

[73] Assignee: Fuji Photo Film Co., Ltd., Kanagawa, Japan

[21] Appl. No.: 119,615

[22] Filed: Nov. 12, 1987

[30] Foreign Application Priority Data

Nov. 12, 1986 [JP] Japan ..... 61-268872

[51] Int. Cl.[4] ..... G03C 1/08; G03C 7/26; G03C 7/32; G03C 5/44

[52] U.S. Cl. ..... 430/543; 430/223; 430/226; 430/376; 430/384; 430/385; 430/386; 430/387; 430/388; 430/389; 430/393; 430/430; 430/460; 430/461; 430/463; 430/486; 430/487; 430/549; 430/552; 430/553; 430/554; 430/555; 430/556; 430/558; 430/955; 430/957; 430/958

[58] Field of Search ..... 430/543, 549, 552, 553, 430/554, 555, 556, 557, 558, 463, 460, 430, 486, 487, 461, 393, 376, 384–389, 958, 955, 957, 554; 436/957, 551, 223, 226

[56] References Cited

U.S. PATENT DOCUMENTS

| | | | |
|---|---|---|---|
| 3,961,959 | 6/1976 | Fujiwhara et al. | 430/423 |
| 4,183,752 | 1/1980 | Küffner et al. | 430/382 |
| 4,652,516 | 3/1987 | Ichijima et al. | 430/544 |
| 4,698,297 | 10/1987 | Ichijima et al. | 430/380 |

FOREIGN PATENT DOCUMENTS

| | | |
|---|---|---|
| 0193389 | 9/1986 | European Pat. Off. . |
| 61-201247 | 3/1986 | Japan . |

OTHER PUBLICATIONS

Research Disclosure "Bleach Accelerator Releasing Couplers" #11449 (1973).

*Primary Examiner*—Mukund J. Shah
*Attorney, Agent, or Firm*—Sughrue, Mion, Zinn, Macpeak & Seas

[57] ABSTRACT

A silver halide photographic material is described, comprising a support having provided thereon at least one silver halide photographic emulsion layer and comprising a bleach accelerator-releasing coupler, wherein said bleach accelerator-releasing coupler is represented by formula (I)

$$A—(TIME)_n—S—X-[(Y)_m—(Z)l]a \quad (I)$$

wherein A represents a coupler residual group; TIME represents a timing group; n represents 0 or 1; X represents a cyclic aliphatic group or a saturated heterocyclic group; Y represents an aliphatic group having from 1 to 8 carbon atoms which may contain a group of —O—, a group of —S—, a group of —COO—, a group of —CO—, a group of $$-\underset{\underset{R_1}{|}}{N}CO-,$$

a group of $$-\underset{\underset{R_1}{|}}{N}-,$$

a group of $—SO_2—$ or a group of $$-\underset{\underset{R_1}{|}}{N}SO_2-$$

in its chain; m represents an integer of from 0 to 3, and when m represents 2 or more, the two or more Y groups may be the same or different; Z represents a group of —OH, a group of —COOM, a group of $—SO_3M$ or a group of $$-N\begin{matrix} R_2 \\ R_3 \end{matrix};$$

l represents an integer of from 1 to 3, and when l represents 2 or more, the two or more Z groups may be the same or different; a represents 1 or 2, and when a represents 2, the two (Y)m—(Z)l groups may be the same or different; $R_1$, $R_2$, and $R_3$ each represents a hydrogen atom, or an aliphatic group having from 1 to 4 carbon atoms; and M represents an alkali metal ion, an ammonium ion, or a hydrogen atom.

The bleach accelerator-releasing coupler used in the present invention maintains its good bleach accelerating effect under running conditions. The silver halide photographic material enables rapid processing because of its high silver bleaching speed.

A method for processing the silver halide photographic material is also described, wherein the photographic material is not subjected to, between the color developing step and the bleach-fixing step, to a water washing step.

20 Claims, No Drawings

MATERIAL COMPRISING A NOVEL BLEACH ACCELERATOR-RELEASING COUPLER

FIELD OF THE INVENTION

The present invention relates to a silver halide photographic material containing a bleach accelerator releasing coupler.

BACKGROUND OF THE INVENTION

Photographic materials useful for forming dye images according to a method which includes a bleaching step are known and commercially used. Such materials and methods are described, for example, in *The Theory of the Photographic Process,* Fourth Edition, edited by T. H. James, pages 462 to 463 and pages 335 to 361. The use of a bleach accelerator releasing coupler in such photographic material is described in *Research Disclosure,* No. 11449 (1973) and Japanese Patent Application (OPI) No. 201247/86 (the term "OPI" as used herein means a "published unexamined Japanese patent application").

However, it has been found that while bleach accelerators released from these bleach accelerator releasing couplers exhibit a certain degree of effect in the case of using a fresh developing solution, their bleach accelerating effect remarkably decreases under a conventional running condition wherein a developing solution or other solution has been carried over into a bleaching solution or a bleach-fixing solution.

Such a phenomenon may be explained as follows.

A bleach accelerator which is released from a bleach accelerator releasing coupler in a developing solution adsorbed to developed silver. In this case, an active species may be a thiol compound or a disulfide compound, although it is difficult to specify which compound is the active species. However, since it is known that a thiol forms a disulfide by aerial oxidation, etc., particularly rapidly in an alkaline solution as described in *Shin-Jikkenkaqaku Koza,* Vol. 14, page 1735, Maruzen (1978), a disulfide is presumably formed during development processing.

It is known that the thiol or disulfide formed which is a bleach accelerator is attached by sulfite ion present in a developing solution and produces a thiol sulfonate as described in L. C. Schoroeter, *Sulfur Dioxide,* page 145, Pergamon Press (1966). Accordingly, it is believed that a reason for the decrease in bleach accelerating effect under the running condition described above is that a thiol or disulfide forms a thio sulfonate ion with a sulfite ion carried over from a developing solution to a bleaching solution and loses adsorptive power to developed silver.

Thus, these known bleach accelerator releasing couplers are insufficient in bleach accelerating effect under practical running conditions and further improvement has been desired.

Further, couplers which have a thioether group at the coupling position are described, for example, in U.S. Pat. Nos. 3,227,554 and 4,293,691. These couplers are useful as so-called DIR couplers or two-equivalent couplers. However, they have an insufficient bleach accelerating effect and some of them rather deteriorate bleaching property.

SUMMARY OF THE INVENTION

Therefore, an object of the present invention is to provide a novel bleach accelerator releasing coupler having a bleach accelerating effect which does not deteriorate under the running condition.

Another object of the present invention is to provide a method for processing a silver halide photographic material which has a high silver bleaching speed and enables a rapid processing.

Other objects of the present invention will become apparent from the following detailed description and examples.

These objects of the present invention can be attained by a silver halide photographic material comprising a support having provided thereon at least one silver halide photographic emulsion layer and comprising a bleach accelerator releasing coupler, wherein the bleach accelerator releasing coupler is represented by formula (I)

$$A\text{—}(TIME)_n\text{—}S\text{—}X\text{—}[(Y)_m\text{—}(Z)_l]_a \qquad (I)$$

wherein A represents a coupler residual group; TIME represents a timing group; n represents 0 or 1; X represents a cyclic aliphatic group or a saturated heterocyclic group; Y represents an aliphatic group having from 1 to 8 carbon atoms which may contain a group of —O—, a group of —S—, a group of —COO—, a group of —CO—, a group of $$\text{—}\underset{\underset{R_1}{|}}{N}\text{CO—},$$

a group of $$\text{—}\underset{\underset{R_1}{|}}{N}\text{—},$$

a group of $—SO_2—$, or a group of $$\text{—}\underset{\underset{R_1}{|}}{N}SO_2\text{—}$$

in its chain; m represents an integer of from 0 tO 3, and when m represents 2 or more, the two or more Y groups may be the same or different; Z represents a group of —OH, a group of —COOM, a group of $—SO_3M$ or a group of $$\text{—}N\begin{matrix}R_2\\R_3\end{matrix};$$

l represents an integer of from 1 to 3, and when l represents 2 or more, the two or more Z groups may be the same or different; a represents 1 or 2, and when a represents 2, the two $(Y)_m—(Z)_l$ groups may be the same or different; $R_1$, $R_2$, and $R_3$ each represents a hydrogen atom or an aliphatic group having from 1 to 4 carbon atoms; and M represents an alkali metal ion, an ammonium ion, or a hydrogen atom.

DETAILED DESCRIPTION OF THE INVENTION

The bleach accelerator releasing coupler represented by formula (I) which can be used in the present invention will be described in detail.

The cyclic aliphatic group represented by X is preferably a saturated or unsaturated cyclic aliphatic group having from 3 to 8 carbon atoms, preferably from 4 to 6 carbon atoms (excluding an aromatic ring). It is preferred that the cyclic aliphatic group does not have a substituent other than $-[(Y)_m-(Z)_l]_a$. However, when one or more of other substituents are present, representative examples include an aliphatic group having from 1 to 4 carbon atoms, a halogen atom, an alkoxy group having from 1 to 4 carbon atoms, and an alkoxycarbonyl group having from 2 to 4 carbon atoms, etc.

The saturated heterocyclic group represented by X is preferably a 3-membered to 8-membered, preferably 4-membered to 6-membered saturated heterocyclic group containing, as a hetero atom, at least one of an oxygen atom, a nitrogen atom, and a sulfur atom, and having from 1 to 7 carbon atoms, preferably from 1 to 5 carbon atoms. Furthermore, a carbonyl group may be included in an atomic group forming a ring. It is preferred that the heterocyclic group does not have a substituent other than $-[(Y)_m-(Z)_l]_a$. However, when one or more of other substituents are present, representative examples include an aliphatic group having from 1 to 4 carbon atoms, a halogen atom, an alkoxy group having from 1 to 4 carbon atoms, and an alkoxycarbonyl group having from 2 to 4 carbon atoms, etc.

Representative examples of the hetero rings include an aziridine ring, an oxirane ring, a sulforane ring, a 1,2-oxathiorane ring, a tetrahydrofuran ring, a tetrahydrothiophene ring, an imidazolidine ring, an azetidine ring, a piperidine ring, a 1,3-thiazolidine ring, a morpholine ring, a γ-butyrolactone ring, a pyrrolidine ring, and a 2,4-dioxo-1,3-imidazolidine ring, etc.

The aliphatic group represented by Y may be a straight chain, branched chain or cyclic, saturated or unsaturated aliphatic group. When the groups of —O—, —S—, —COO—, —CO—, $$-\underset{\underset{R_1}{|}}{N}-CO-,\ -\underset{\underset{R_1}{|}}{N}-,\ -SO_2-,\ \text{and}\ -\underset{\underset{R_1}{|}}{N}SO_2-$$

are included in the chain, they may be present at an interim position or a terminal position.

Suitable examples of the aliphatic groups represented by $R_1$, $R_2$, or $R_3$ include a methyl group, an ethyl group, a propyl group, an isopropyl group, a Sec-butyl group, a n-butyl group, etc.

Suitable examples of the coupler residual groups represented by A include a yellow coupler residual group (for example, an open-chain ketomethylene type coupler residual group, etc.), a magenta coupler residual group (for example, a 5-pyrazolone type coupler residual group, a pyrazoloimidazole type coupler residual group, a pyrazolotriazole type coupler residual group, etc.), a cyan coupler residual group (for example, a phenol type coupler residual group, a naphthol type coupler residual group, etc.), and a non-color forming coupler residual group (for example, an indanone type coupler residual group, an acetophenone type coupler residual group, etc.), etc. Further, the heterocyclic type coupler residual groups as described in U.S. Pat. Nos. 4,315,070, 4,183,752, 4,174,969, 3,961,959 and 4,171,223, etc., are also useful.

More preferred coupler residual groups include those represented by formula (Cp-1), (Cp-2), (Cp-3), (Cp-4), (Cp-5), (Cp-6), (Cp-7), (Cp-8), or (Cp-9) described below. These coupler residual groups are preferred because of their high coupling rates.

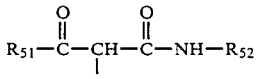
(Cp-1)

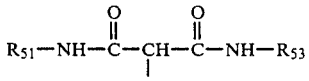
(Cp-2)

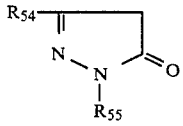
(Cp-3)

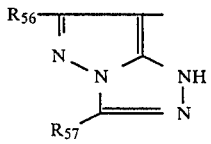
(Cp-4)

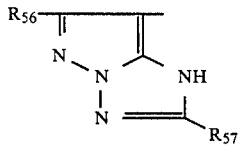
(Cp-5)

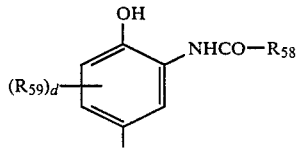
(Cp-6)

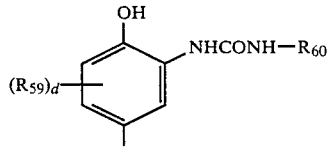
(Cp-7)

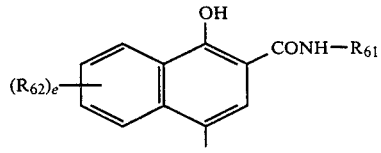
(Cp-8)

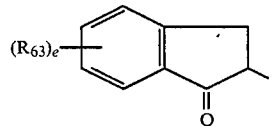
(Cp-9)

In the above-described formulae, a free bond attached to the coupling position indicates a position to which a group capable of being released upon coupling is bonded. When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ in the above-described formulae contains a diffusion-resistant group, it is selected so that the total number of carbon atoms included therein is from 8 to 40, and preferably from 10 to 30. In other cases, the total number of carbon atoms included therein is preferably not more than 15. In cases of bis type, telomer type, or polymer type couplers, any of the above-described substituents forms a divalent group and may connect to a repeating unit, etc. In such cases, the total number of carbon atoms can be outside of the above-described range.

Now, $R_{51}$ to $R_{63}$, d and e in the above-described formulae (Cp-1) to (Cp-9) are explained in detail. In the following, $R_{41}$ represents an aliphati group, an aromatic group or a heterocylic group; $R_{42}$ represents an aromatic group or a heterocylic group; and $R_{43}$, $R_{44}$, and $R_{45}$ each represents a hydrogen atom, an aliphatic group, an aromatic group, or a heterocyclic group.

$R_{51}$ represents a group as defined for $R_{41}$.

$R_{52}$ and $R_{53}$ each represents a group as defined for $R_{42}$.

$R_{54}$ represents a group as defined for $R_{41}$, a group of $$R_{41}\underset{\underset{R_{43}}{|}}{C}ON-,$$

a group of $$R_{41}\underset{\underset{R_{43}}{|}}{N}-,$$

a group of $$R_{41}SO_2\underset{\underset{R_{43}}{|}}{N}-,$$

a group of $R_{41}S$—, a group of $R_{43}O$—, a group of $$R_{45}\underset{\underset{R_{43}}{|}}{N}C\underset{\underset{R_{44}}{|}}{O}N-,$$

a group of $R_{41}OOC$—, a group of $$R_{44}\underset{\underset{R_{43}}{|}}{N}CO-,$$

or a group of N≡C—.

$R_{55}$ represents a group as defined for $R_{41}$.

$R_{56}$ and $R_{57}$ each represents a group as defined for $R_{43}$, a group of $R_{41}S$—, a group of $R_{41}O$—, a group of $$R_{41}\underset{\underset{R_{43}}{|}}{C}ON-,$$

a group of $$R_{41}\underset{\underset{R_{43}}{|}}{N}-,$$

a group of $$R_{43}\underset{\underset{R_{44}}{|}}{N}C\underset{\underset{R_{45}}{|}}{O}N-,$$

or a group of $$R_{41}SO_2\underset{\underset{R_{43}}{|}}{N}-.$$

$R_{58}$ represents a group as defined for $R_{41}$.

$R_{59}$ represents a group as defined for $R_{41}$, a group of $$R_{41}\underset{\underset{R_{43}}{|}}{C}ON-,$$

a group of $$R_{41}O\underset{\underset{R_{43}}{|}}{C}ON-,$$

a group of $$R_{41}SO_2\underset{\underset{R_{43}}{|}}{N}-,$$

a group of $$R_{43}\underset{\underset{R_{44}}{|}}{N}C\underset{\underset{R_{45}}{|}}{O}N-,$$

a group of $$R_{43}\underset{\underset{R_{44}}{|}}{N}SO_2\underset{\underset{R_{45}}{|}}{N}-,$$

a group of $R_{41}O$—, a group of $R_{41}S$—, a halogen atom, or a group of $$R_{41}\underset{\underset{R_{43}}{|}}{N}-.$$

d represents an integer from 0 to 3. When d represents 2 or more, the two or more $R_{59}$ groups may be the same or different. Further, each of two $R_{59}$ groups may be a divalent group connected with each other to form a cyclic structure.

Examples of the divalent groups for forming a cyclic structure includes a group of

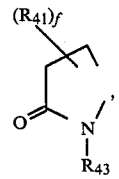

a group of

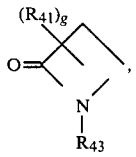

or a group of

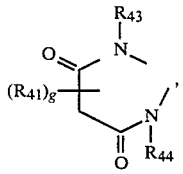

wherein f represents an integer from 0 to 4; and g represents an integer from 0 to 2.

$R_{60}$ represents a group as defined for $R_{41}$.

$R_{61}$ represents a group as defined for R41.

$R_{62}$ represents a group as defined for $R_{41}$, a group of $R_{41}CONH$—, a group of $R_{41}OCONH$—, a group of $R_{41}SO_2NH$—, a group of $$R_{43}\underset{\underset{R_{44}}{|}}{N}C\underset{\underset{R_{45}}{|}}{N}—,$$

a group of $$R_{43}\underset{\underset{R_{44}}{|}}{N}SO_2\underset{\underset{R_{45}}{|}}{N}—,$$

a group of $R_{43}O$—, a group of $R_{41}S$—, a halogen atom, or a group of $$R_{41}\underset{\underset{R_{43}}{|}}{N}—.$$

$R_{63}$ represents a group as defined for $R_{41}$, a group of $$R_{43}C\underset{\underset{R_{44}}{|}}{N}—,$$

a group of $$R_{43}\underset{\underset{R_{44}}{|}}{N}CO—,$$

a group of $$R_{41}SO_2\underset{\underset{R_{44}}{|}}{N}—,$$

a group of $$R_{43}\underset{\underset{R_{44}}{|}}{N}SO_2—,$$

a group of $R_{41}SO_2$—, a group of $R_{43}OCO$—, a group of $R_{43}OSO_2$—, a halogen atom, a nitro group, a cyano group or a group of $R_{43}CO$—.

e represents an integer from 0 to 4. When e represents 2 or more, the two or more $R_{62}$ groups or $R_{63}$ groups may be the same or different.

The aliphatic group noted above is an aliphatic hydrocarbon group having from 1 to 32 carbon atoms, preferably from 1 to 22 carbon atoms, and may be saturated or unsaturated, straight chain, branched chain, or cyclic, and substituted or unsubstituted. Representative examples of the unsubstituted aliphatic group include a methyl group, an ethyl group, a propyl group, an isopropyl group, a butyl group, a tert-butyl group, an isobutyl group, a tert-amyl group, a hexyl group, a cyclohexyl group, a 2-ethylhexyl group, an octyl group, a, 1,1,3,3-tetramethylbutyl group, a decyl group, a dodecyl group, a hexadecyl group, an octadecyl group, etc.

The aromatic group noted above is an aromatic group having from 6 to 20 carbon atoms, and preferably an unsubstituted or substituted phenyl group or an unsubstituted or substituted naphthyl group.

The heterocyclic group noted above is a heterocyclic group having from 1 to 20 carbon atoms, preferably from 1 to 7 carbon atoms, and contains at least one of a nitrogen atom, an oxygen atom, and a sulfur atom, as a hetero atom, and preferably a three-membered to eight-membered, substituted or unsubstituted heterocyclic group. Representative examples of the unsubstituted heterocyclic group include a 2-pyridyl group, a 4-pyridyl group, a 2-thienyl group, a 2-furyl group, a 2-imidazolyl group, a pyrazinyl group, a 2-pyrimidinyl group, a imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, 2,4-dioxo-1,3-imidazolidin-3-yl group, a succinimido group, a phthalimido group, a 1,2,4-triazol-2-yl group, a 1-pyrazolyl group, etc.

The aliphatic group, aromatic group, and heterocyclic group may have one or more substituents as described above. Representative examples of the substituents include a halogen atom, a group of $R_{47}O$—, a group of $R_{46}S$—, a group of $$R_{47}C\underset{\underset{R_{48}}{|}}{N}—,$$

a group of $$R_{47}\underset{\underset{R_{48}}{|}}{N}CO—,$$

a group of $$R_{46}OC\underset{\underset{R_{47}}{|}}{N}—,$$

a group of $R_{46}SO_2N(R_{47})$—, a group of $R_{47}NSO_2(R_{48})$—, a group of $R_{46}SO_2$—, a group of $R_{47}OCO$—, a group of $R_{47}NCON(R_{48})(R_{49})$—, a group of $R_{46}$, a group of

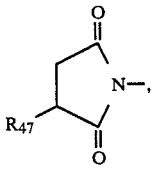

a group of $R_{46}COO$—, a group of $R_{47}OSO_2$—, a cyano group, a nitro group, etc. In the above described formulae, $R_{46}$ represents an aliphatic group, an aromatic group, or a heterocyclic group; and $R_{47}$, $R_{48}$, and $R_{49}$ each represents a hydrogen atom, an aliphatic group, an aromatic group or a heterocyclic group. The aliphatic group, aromatic group and heterocyclic group each has the same meaning as defined above.

The preferred scope of $R_{51}$ to $R_{63}$, d and e in the above-described formulae (Cp-1) to (Cp-9) is described below.

$R_{51}$ preferably an aliphatic group or an aromatic group.

$R_{52}$, $R_{53}$, and $R_{55}$ each is preferably an aromatic group.

$R_{54}$ is preferably a group of $R_{41}CONH$— or a group of $R_{41}$—N($R_{43}$)—.

$R_{56}$ and $R_{57}$ each is preferably an aliphatic group, a group of $R_{41}O$—, or a group of $R_{41}S$—.

$R_{58}$ is preferably an aliphatic group or an aromatic group.

$R_{59}$ in formula (Cp-6) is preferably a chlorine atom, an aliphatic group, or a group of $R_{41}CONH$—.

d in formula (Cp-6) is preferably 1 or 2.

$R_{60}$ is preferably an aromatic group.

$R_{59}$ in formula (Cp-7) is preferably a group of $R_{41}CONH$—.

d in formula (Cp-7) is preferably 1.

$R_{61}$ is preferably an aliphatic group or an aromatic group.

e in formula (Cp-8) is preferably 0 or 1.

$R_{62}$ is preferably a group of $R_{41}OCONH$—, a group of $R_{41}CONH$—, or a group of $R_{41}SO_2NH$—. The position of $R_{62}$ is preferably the 5-position of the naphthol ring.

$R_{63}$ is preferably a group of $R_{41}CONH$—, a group of $R_{41}SO_2NH$—, a group of $R_{44}NSO_2(R_{43})$—, a group of $R_{41}SO_2$—, a group of $R_{44}NCO(R_{43})$—, a nitro group, or a cyano group.

Representative examples of $R_{51}$ to $R_{63}$ are set forth below.

Examples of $R_{51}$ include a tert-butyl group, a 4-methoxyphenyl group, a phenyl group, a 3-[2-(2,4-di-tertamylphenoxy)butanamido]phenyl group, a 4-octadecyloxyphenyl group, a methyl group, etc.

Examples of $R_{52}$ and $R_{53}$ include a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-tert-amylphenoxy)butanamido]phenyl group, a 2-chloro-5-[2-(2,4-di-tertamylphenoxy)butanamido]phenyl group, 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxycarbonylethoxycarbonyl)phenyl group, a 2-chlorophenyl group, a 2-ethoxyphenyl group, etc.

Examples of $R_{54}$ include a 3-[2,4-di-tert-amyltetradecanamidoanilino]benzamido group, a 3-[4-(2,4-di-tertamylphenoxy)butanamido]benzamido group, a 2-chloro-5-tetradecanamidoanilino group, a 5-(2,4-di-terty-amylphenoxyacetamido)benzamido group, a 2-chloro-5-dodecenylsuccinimidoanilino group, a 2-chloro-5-[2-(3-tert-butyl-4-hydroxyphenoxy)tetradecanamido]anilino group, a 2,2-dimethylpropanimido group, a 2-(3-pentadecylphenoxy)-butanamido group, a pyrrolidino group, an N,N-dibutylamino group, etc.

Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-tert-amylphenoxy)butanamido]phenyl group, a 2,6-dichloro-4-methanesulfonylphenyl group, etc.

Examples of $R_{56}$ include a methyl group, an ethyl group, an isopropyl group, a methoxy group, an ethoxy group, a methylthio group, an ethylthio group, a 3-phenylureido group, a 3-butylureido group, a 3-(2,4-di-tertamylphenoxy)propyl group, etc.

Examples of $R_{57}$ include a 3-(2,4-di-tert-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)-phenylsulfonamido]phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]ethyl group, a dodecylthio group, etc.

Examples of $R_{58}$ include a 2-chlorophenyl group, a pentafluorophenyl group, a heptafluoropropyl group, a 1-(2,4-di-tert-amylphenoxy)propyl group, a 3-(2,4-di-tertamylphenoxy)propyl group, a 2,4-di-tert-amylmethyl group, a furyl group, etc.

Examples of $R_{59}$ include a chlorine atom, a methyl group, an ethyl group, a propyl group, a butyl group, an isopropyl group, a 2-(2,4-di-tert-amylphenoxy)-butanamido group, a 2-(2,4-di-tert-amylphenoxy)hexanamido group, a 2-(2,4-di-tert-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, a 2-[2-(2,4-di tert-amylphenoxyacetamido)phenoxy]butanamido group, etc.

Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, a 3-methoxycarbonylphenyl group, etc.

Examples of $R_{61}$ include a dodecyl group, a hexadecyl group, a cyclohexyl group, a butyl group, a 3-(2,4-di-tert-amylphenoxy)propyl group, a 4-(2,4-di-tert-amylphenoxy)butyl group, a 3-dodecyloxypropyl group, a 2-tetradecyloxyphenyl group, a tert-butyl group, a 2-(2-hexadecyloxy)phenyl group, a 2-methoxy-5-dodecyloxycarbonylphenyl group, a 2-butoxyphenyl group, a 1-naphthyl group, etc.

Examples of $R_{62}$ include an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, an acetamido group, etc.

Examples of $R_{63}$ include a 2,4-di-tert-amylphenoxyacetamido group, a 2-(2,4-di-tert-amylphenoxy)-butanamido group, a hexadecylsulfonamido group, an N-methyl-N-octadecylsulfamoyl group, an N,N-dioctylsulfamoyl group, a dodecyloxycarbonyl group, a chlorine atom, a fluorine atom, a nitro group, a cyano group, an N-3-(2,4-di-tertamylphenoxy)propylsulfamoyl group, a methanesulfonyl group, a hexadecylsulfonyl group, etc.

In formula (I), the group represented by TIME may or may not be present in accordance the present invention. It is preferred not to use the group represented by TIME. When used, an appropriate group can be selected depending on the purpose. Suitable examples of the group represented by TIME include known linking groups described below.

(1) A group utilizing a cleavage reaction of hemiacetal.

Examples of these groups include those as described, for example, in U.S. Pat. No. 4,146,396, Japanese Patent Application (OPI) Nos. 249148/85 and 249149/85, etc., and are represented by formula (T-1)

(T-1)

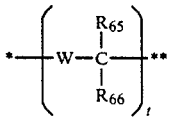

wherein the bond indicated by * denotes the position at which the group is connected to the left side group in formula (I); the bond indicated by ** denotes the position at which the group is connected to the right side group in formula (I); W represents an oxygen atom, a sulfur atom or a group of

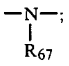

$R_{65}$ and $R_{66}$ each represents a hydrogen atom, an alkyl group, an aryl group or a heterocyclic ring group or $R_{65}$ and $R_{66}$ may represent a divalent group connected with each other to form a carbon ring or a heterocyclic ring; $R_{67}$ represents an acyl group, a sulfonyl group, or a sulfamoyl group or $R_{67}$ may represent a divalent group connected with $R_{65}$ or $R_{66}$ to form a heterocyclic ring; t represents 1 or 2; and when t represents 2, the two

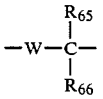

groups may be the same or different.

Representative examples of the substituents represented by $R_{65}$, $R_{66}$, or $R_{67}$ include a group of $R_{69}$, a group of $R_{69}CO$—, a group of $R_{69}SO_2$—, a group of

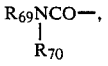

and a group of

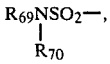

etc., wherein $R_{69}$ has the same meaning as defined for $R_{41}$ above; and $R_{70}$ has the same meaning as defined for $R_{43}$ above.

Specific examples of the groups represented by formula (T-1) are set forth below.

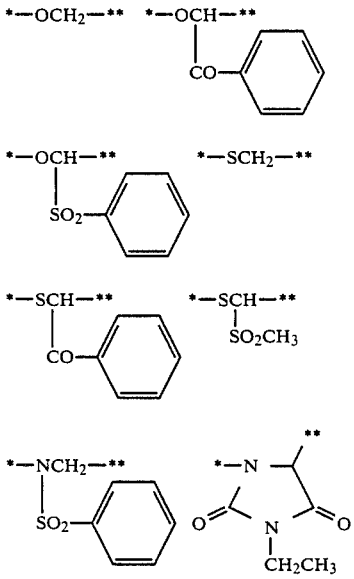

-continued

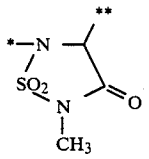

(2) A group causing a cleavage reaction utilizing an intramolecular nucleophilic displacement reaction.

Examples of these groups include timing groups as descried in U.S. Pat. No. 4,248,962, etc., and are represented by formula (T-2)

$$*\text{—Nu—Link—E—}^{**} \qquad \text{(T-2)}$$

wherein the bond indicated by * denotes the position at which the group is connected to the left side group in formula (I); the bond indicated by  denotes the positoin at which the group is connected to the right side group in formula (I); Nu represents nucleophilic group, such as an oxygen atom, a sulfur atom, etc; E represents an electrophilic group which is able to cleave the bond indicated by  upon a nucleophilic attack of Nu; and Link represents a linking group which connects Nu with E in a stereochemical position capable of causing an intramolecular nucleophilic displacement reaction between Nu and E.

Specific examples of the groups represented by formula (T-2) are set forth below.

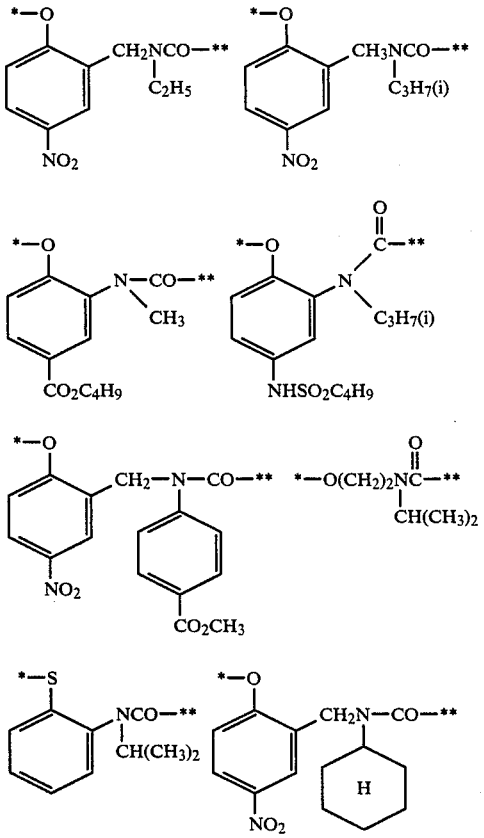

(3) a group causing a cleavage reaction utilizing an electron transfer reaction via a conjugated system.

Examples of these groups include those as described in U.S. Pat. Nos. 4,409,323 and 4,421,845, and are represented by formula (T-3)

$$*\text{—W}\left(\text{C}(R_{65})=\text{C}(R_{66})\right)_t\text{CH}_2\text{—}^{**} \qquad \text{(T-3)}$$

wherein the bond indicated by *, the bond indicated by **, w, $R_{65}$, $R_{66}$, and t each has the same meaning as defined for formula (T-1) above.

Specific examples of the groups represented by formula (T-3) are set forth below.

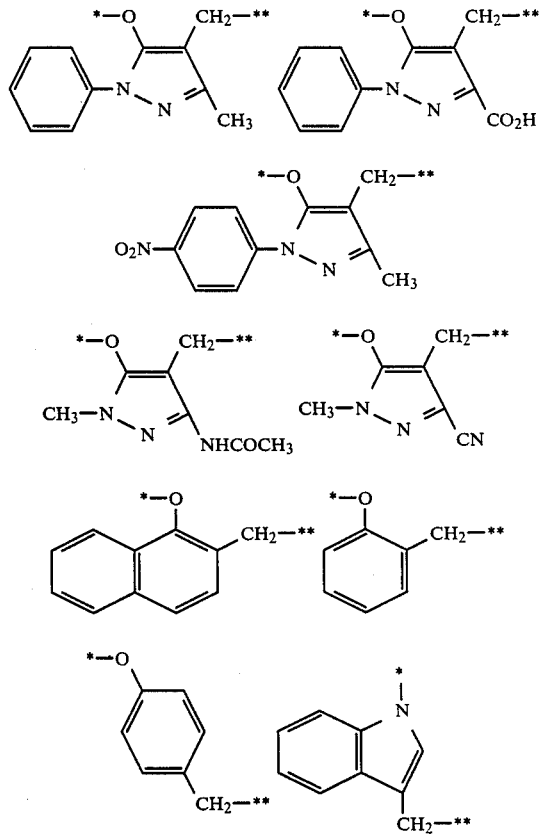

(4) A group utilizing a cleavage reaction of an ester upon hydrolysis.

Examples of these groups include those as described in West German Patent Application (OLS) No. 2,626,315, etc., and are represented by formula (T-4) or (T-5)

$$*\text{—O—}\overset{\overset{\text{O}}{\|}}{\text{C}}\text{—}^{**} \qquad \text{(T-4)}$$

$$*\text{—S—}\overset{\overset{\text{S}}{\|}}{\text{C}}\text{—}^{**} \qquad \text{(T-5)}$$

wherein the bond indicated by * and the bond indicated by ** each has the same meaning as defined for formula (T-1) above.

(5) A group utilizing a cleavage reaction of an iminoketal.

Examples of these groups include those as described in U.S Pat. No. 4,546,073, and are represented by the formula (T-6)

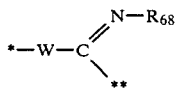

(T-6)

wherein the bond indicated by *, the bond indicated by ** and W each has the same meaning as defined for formula (T-1); and $R_{68}$ has the same meaning as defined for $R_{67}$ in formula (T-1) above.

Specific examples of the groups represented by formula (T-6) are set forth below

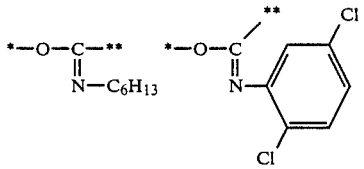

-continued

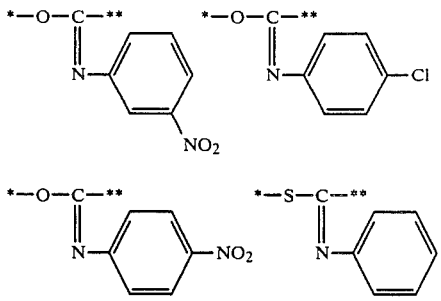

Specific examples of the bleach accelerator-releasing couplers represented by formula (I) according to the present invention are set forth below, but the present invention should not be construted as being limited thereto.

(1)

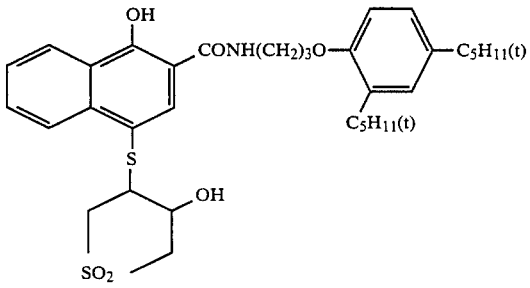

(2)

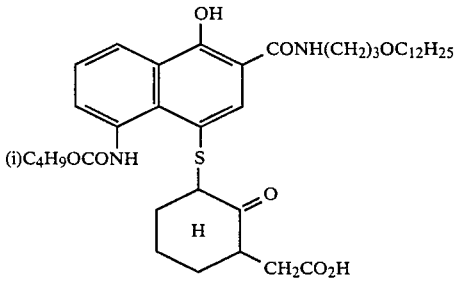

(3)

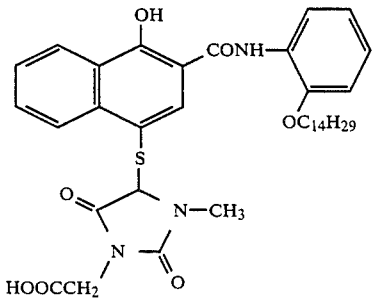

-continued
(4)
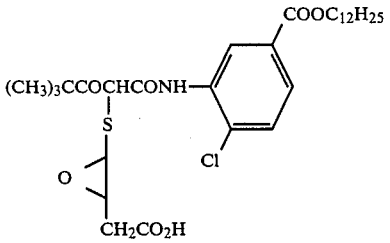
(5)
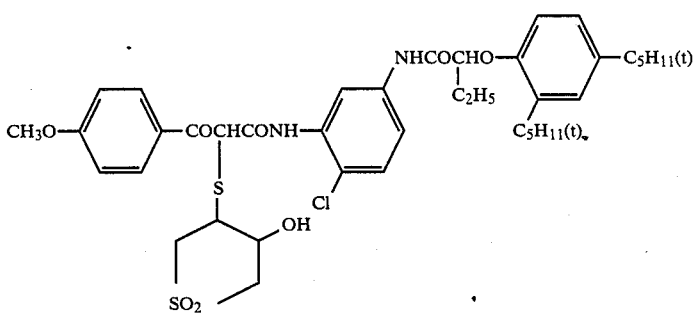
(6)
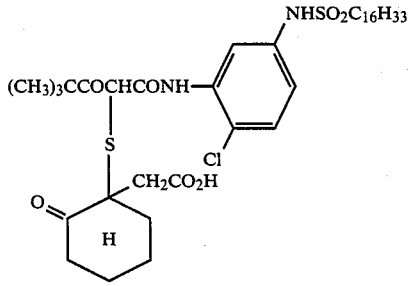
(7)
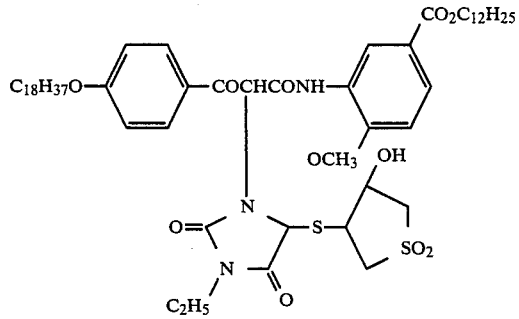
(8)
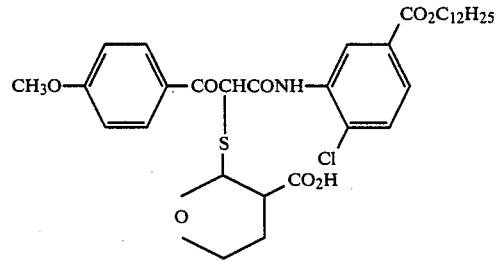

-continued
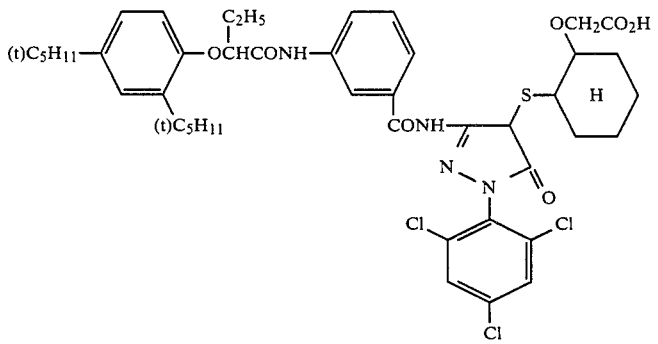
(9)
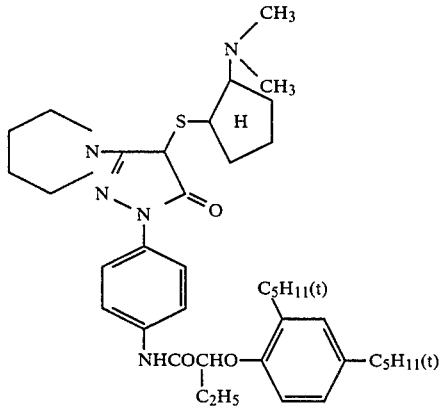
(10)
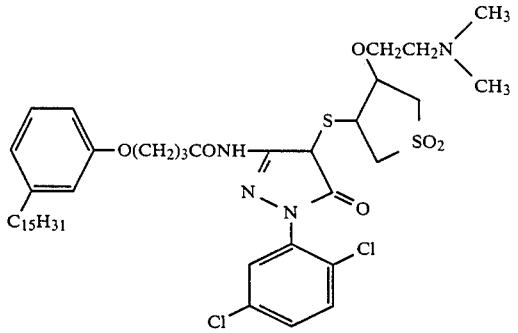
(11)
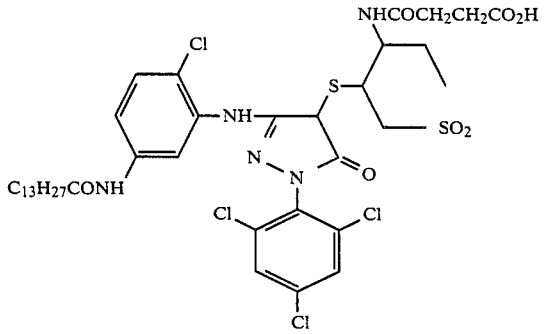
(12)

-continued
(13)
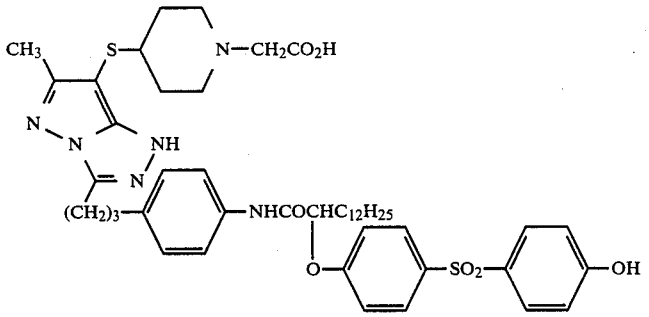
(14)
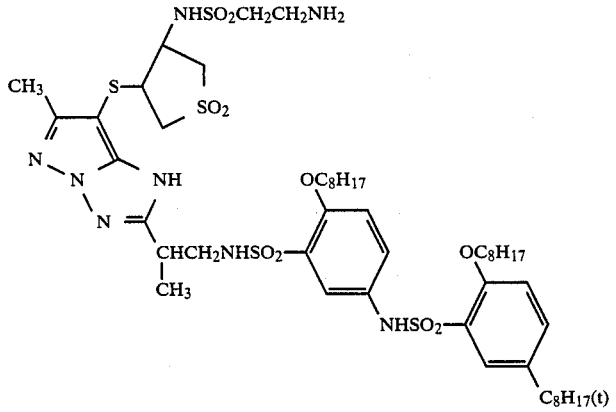
(15)
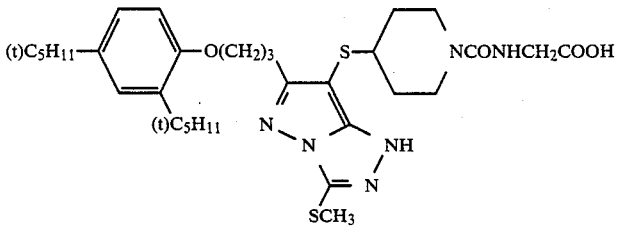
(16)
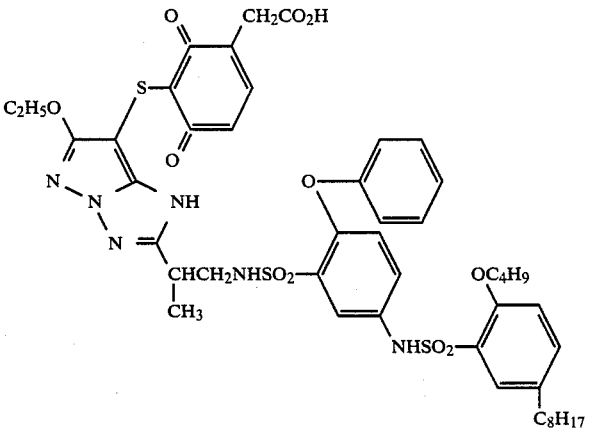

-continued
(17)
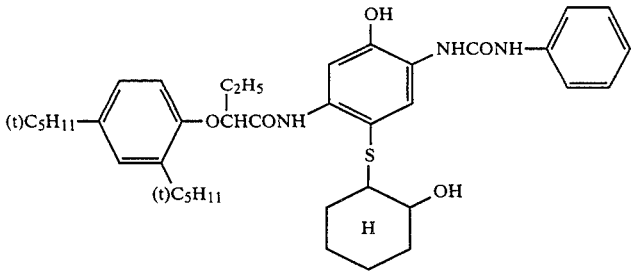
(18)
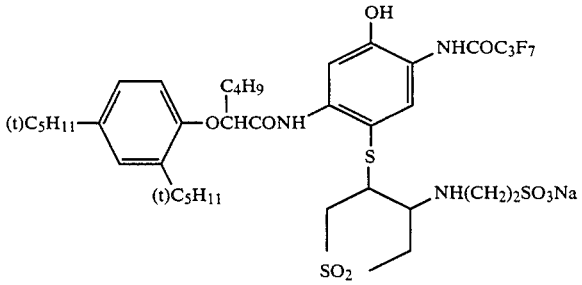
(19)
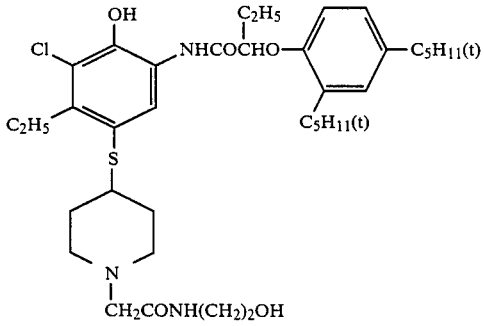
(20)
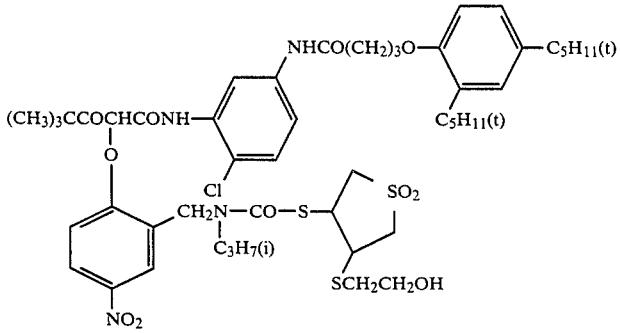
(21)
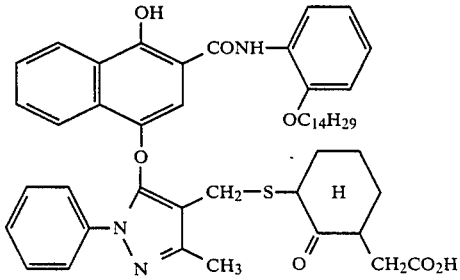

-continued (22)

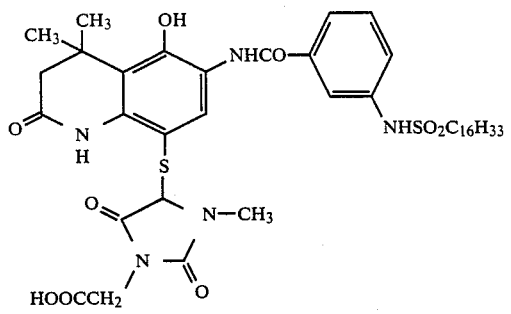

(23)

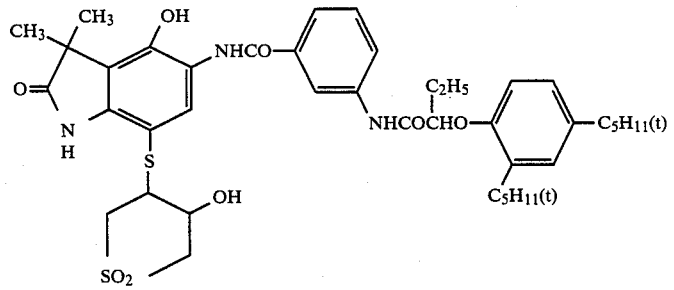

(24)

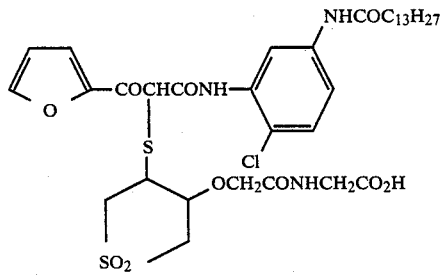

The couplers used in the present invention can be synthesized by known methods or methods analogous thereto. For example, methods as described in U.S. Pat. Nos. 4,293,691 and 4,264,723, Japanese Patent Application (OPI) Nos. 29805/80, 25056/80, 29805/80, 85864/83, etc., can be utilized.

A representative synthesis method is specifically described below, but other compounds may be synthesized in a manner similar thereto.

SYNTHESIS EXAMPLE

Synthesis of Compound (1)

To 200 ml of tetrahydrofuran, were added 24.7 g of 2-[3-(2,4-di-tert-amylphenoxy)propyl]carbamoyl-4-mercapto-1-naphthol, 85 g of 4-chlorotetrahydrothiophen-3-ol-1,1-dioxide and 5.7 g of tetramethyl guanidine and the mixture was stirred at room temperature for 1 hour. The reaction mixture was pound into diluted hydrochloric acid while cooling with ice, extracted with ethyl acetate and the ethyl acetate layer was washed with water until the aqueous layer indicated neutral. The solvent was distilled off under a reduced pressure and the residue was crystallized using ether to obtain 16.3 g of Compound (1).

The bleach accelerator-releasing coupler represented by formula (I) according to the present invention can be incorporated into an emulsion layer or a light-insensitive intermediate layer. It is preferred to incorporate it into an emulsion layer. In the case of adding a large amount of the coupler, it is desirable to add it to a light-insensitive intermediate layer in view of little ill effect such as decrease in sensitivity, etc.

The amount of the coupler to be added is generally from 0.01 mol % to 100 mol %, preferably from 0.1 mol % to 50 mol % and particularly preferably from 1 mol % to 20 mol % based on the total coating amount of silver.

In the photographic emulsion layers of the photographic light-sensitive material used in the present invention, a preferably employed silver halide is silver chloride, silver bromide, silver iodobromide, silver iodochloride, or silver iodochlorobromide.

Silver halide grains in the silver halide emulsion may have a regular crystal structure, for example, a cubic, octahedral or tetradecahedral structure, etc., an irregular crystal structure, for example, a spherical or tabular structure, etc., a crystal defect, for example, a twin plane, etc., or a composite structure thereof.

A grain size of silver halide may be varied and include from fine grains having about 0.1 micron or less to large size grains having about 10 microns of a diameter of projected area. Further, a polydispersed emulsion and a monodispersed emulsion may be used.

The silver halide photographic emulsion used in the present invention can be prepared using known methods, for example, those as described in *Reserch Disclosure,* RD No. 17643 (December, 1978), pages 22 to 23, "I. Emulsion Preparation and Types" and ibid., RD No. 18716 (November, 1979), page 648; P. Glafkides, *Chimie et Physique Photoqraphique,* Paul Montel (1967), pp.

329–425; G. F. Duffin, *Photographic Emulsion Chemistry,* The Focal Press (1966), pp. 57–82; and V. L. Zelikman et al., *Making and Coating Photographic Emulsion,* The Focal Press (1964), pp. 69–87, etc.

Monodispersed emulsions as described in U.S. Pat. Nos. 3,574,628 and 3,655,394, British Pat. No. 1,413,748, etc., are preferably used in the present invention.

Further, tabular silver halide grains having an aspect ratio of about 5 or more (i.e., 5/1 or more in diameter/-thickness ratio) can be employed in the present invention. The tabular grains may be easily prepared, i.e., by the method as described in Gutoff, *Photographic Science and Engineering,* Vol. 14, pages 248 to 257 (1970), U.S. Pat. Nos. 4,434,226, 4,414,310, 4,433,048 and 4,439,520, British Pat. No. 2,112,157, etc.

Crystal structure of silver halide grains may be uniform, composed of different halide compositions between the inner portion and the outer portion, or may have a layered structure.

Further, silver halide emulsions in which silver halide grains having different compositions are connected upon epitaxial junctions or silver halide emulsions in which silver halide grains are connected with compounds other than silver halide such as silver thiocyanate, lead oxide, etc. may also be employed.

Moreover, a mixture of grains having a different crystal structure may be used.

The silver halide emulsions used in the present invention are usually conducted with physical ripening, chemical ripening and spectral sensitization. Various kinds of additives which can be employed in these steps are described in *Research Disclosure,* RD No. 17643 (December, 1978) and ibid., RD No. 18716 (November, 1979) and concerned items thereof are summarized in the table shown below.

Further, known photographic additives which can be used in the present invention are also described in the above mentioned literature and concerned items thereof are summarized in the table below.

| Kind of Additives | RD No. 17643 | RD No. 18716 |
|---|---|---|
| 1. Chemical Sensitizers | Page 23 | Page 648, right column |
| 2. Sensitivity Increasing Agents | | Page 648, right column |
| 3. Spectral Sensitizers and Super Sensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, left column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* RD No. 17643, "VII-C" to "VII-G".

As yellow couplers used in the present invention, those as described in U.S. Pat. Nos. 3,933,501, 4,022,620, 4,326,024 and 4,401,752, Japanese Patent Publication No. 10739/83, British Pat. Nos. 1,425,020, 1,476,760, etc. are preferred.

As magenta couplers used in the present invention, 5-pyrazolone type and pyrazoloazole type compounds are preferred. Magenta couplers as described in U.S. Pat. Nos. 4,310,619 and 4,351,897, European Pat. No. 73,636, U.S. Pat. Nos. 3,061,432 and 3,725,067, *Research Disclosure,* RD No. 24220 (June, 1984), Japanese Patent Application (OPI) No. 33552/85, *Research Disclosure,* RD No. 24230 (June, 1984), Japanese Patent Application (OPI) No. 43659/85, U.S. Pat. Nos. 4,500,630 and 4,540,654, etc. are particularly preferred.

As cyan couplers used in the present invention, naphthol type and phenol type couplers are exemplified. Cyan couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Pat. No. 121,365A, U.S. Pat. Nos. 3,446,622, 4,333,999, 4,451,559 and 4,427,767, European Pat. No. 161,626A, etc., are preferred.

As colored couplers for correcting undesirable absorptions of dyes formed, those as described in *Research Disclosure,* RD No. 17643, "VII-G", U.S. Pat. No. 4,163,670, Japanese Patent Publication No. 39413/82, U.S. Pat. Nos. 4,004,929 and 4,138,258, British Pat. No. 1,146,368, etc. are preferably employed.

As couplers capable of forming appropriately diffusible dyes, those as described in U.S. Pat. No. 4,366,237, British Pat. No. 2,125,570, European Pat. No. 96,570, West German Patent Application (OLS) No. 3,234,533, etc., are preferably employed.

Typical examples of polymerized dye forming couplers are described in U.S. Pat. Nos. 3,451,820, 4,080,211 and 4,367,282, British Pat. No. 2,103,173, etc.

Couplers capable of releasing a photographically useful residual group during the course of coupling can be also employed preferably in the present invention. As DIR couplers capable of releasing a development inhibitor, those as described in the patents cited in *Research Disclosure,* RD No. 17643, "VII-F" described above, Japanese Patent Application (OPI) Nos. 151944/82, 154234/82 and 184248/85, and U.S. Pat. No. 4,248,962, etc., are preferred.

As couplers which release imagewise a nucleating agent or a development accelerator at the time of development, such as those described in British Pat. Nos. 2,097,140 and 2,131,188, Japanese Patent Application (OPI) Nos. 157638/84 and 170840/84, etc., are preferred.

Furthermore, competing couplers such as those described in U.S. Pat. No. 4,130,427, etc., poly-equivalent couplers such as those described in U.S. Pat. Nos. 4,283,472, 4,338,393 and 4,310,618, etc., DIR redox compound releasing couplers such as those described in Japanese Patent Application (OPI) No. 185950/85, etc., couplers capable of releasing a dye which turns to a colored form after being released such as those described in European Pat. No. 173,302A, etc., and the like may be employed in the photographic material of the present invention.

The couplers which can be used in the present invention can be introduced into the photographic material according to various known dispersing methods.

Suitable examples of organic solvent having a high boiling point which can be employed in an oil droplet-in-water type dispersing method are described in U.S. Pat. No. 2,322,027, etc.

The processes and effects of latex dispersing methods and the specific examples of latexes for loading are described in U.S Pat. No. 4,199,363, West German Patent Application (OLS) Nos. 2,541,274 and 2,541,230, etc.

Suitable supports which can be used in the present invention are described, for example, in *Research Disclosure,* RD No. 17643, page 28 and ibid., RD No. 18716, page 647, right column to page 648, left column, as mentioned above.

The color photographic light-sensitive material according to the present invention can be subjected to development processing in a conventional manner as described in *Research Disclosure,* RD No. 17643, pages 28 to 29 and ibid., RD No. 18716, page 651, left column to right column, as mentioned above.

The color developing solution used for developing the photographic material of the present invention is an alkaline aqueous solution mainly containing preferably an aromatic primary amine type color developing agent. As a color developing agent, an aminophenol type compound is effective and a p-phenylenediamine type compound is preferably used. The representative examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfate, hydrochloride or p-toluenesulfonate thereof. These compounds can be used solely or as a combination thereof.

The color developing solution generally contains pH buffering agents such as carbonates, borates or phosphates of an alkali metal, a development restrainer such as bromide, iodide, benzimidazoles, benzothiazoles, or mercapto compounds or an antifogging agent.

If necessary, various preservatives such as hydroxylamine, diethylhydroxylamine, hydrazine sulfites, phenyl semicarbazides, triethanol amine, catechol sulfonic acids, or triethylenediamine (1,4-diazabicyclo[2,2,2]octane), an organic solvent such as ethylene glycol or diethylene glycol, a development accelerator such as benzyl alchol, polyethylene glycol, quaternary ammonium salt, or amines, a dye forming coupler, a competing coupler, a fogging agent such as sodium boron hydride, an auxiliary developing agent such as 1-phenyl-3-pyrazolidone, a tackifier, various chelating agents as represented by aminopolycarboxylic acid, aminopolyphosphoric acid, alkylphosphoric acid, and phosphonocarboxylic acid, and a compound, e.g., an ethylenediaminetetraacetic acid, a nitrilotriacetic acid, a diethylenetriaminepentaacetic acid, a cyclohexanediaminetetraacetic acid, a hydroxyethyliminodiacetic acid, a 1-hydroxyethylidene-1,1-diphosphonic acid, a nitrilo-N,N,N-trimethylenephosphonic acid, an ethylenediamine-N,N,N',N'-tetramethylenephosphonic acid, and an ethylenediamine-di(o-hydroxyphenylacetic acid), and a salt thereof can be added to the color developing solution.

Regarding the development of the color reversal light-sensitive material, generally a black-and-white development is conducted before a color development. In this case, conventional black-and-white developing agents such as dihydroxybenzenes (e.g., hydroquinone), 3-pyrazolidones (e.g., 1-phenyl-3-pyrazolidone) or aminophenols (e.g., N-methyl-p-aminophenol) can be used alone or in combination with the black-and-white developing solution.

The color developing solution or the black-and-white developing solution used for developing the photographic material of the present invention generally has a pH value of about 9 to 12. The amount of replenishment of these developing solutions is varied according to color photographic materials processed, and conventionally, it is 3 liter or less, per $m^2$ of the material. Further, it can be 500 ml or less by decreasing the bromide ion concentration of the replenisher. In order to decrease the amount of replenishment, it is preferable to prevent evaporating of the solution and aerial oxidation by reducing contact area between the processing tank and air. Furthermore, by using a means to control accumulation of the iodide ion in the developing solution, the amount of replenishment can be decreased.

The photographic emulsion layer after color development is generally bleached. Bleaching step and fixing step may be done simultaneously (i.e., bleach-fixing) or separately. To speed up the processing time, bleach-fixing may be done after bleaching. If necessary, processing in bleach-fixing bath consisting of continuous two tanks, fixing processing before bleach-fixing step, or bleach processing after bleach-fixing step may be employed. The bleaching agents include, for example, compounds of polyvalent metals such as iron (III), cobalt (III), chromium (VI), or copper (II), peracids, quinones and nitro compounds.

Representative examples of bleaching agents include ferricyanate compounds; dichromate; organic acid complex salts of iron (III) or cobalt (III), in which the organic acids are, for example, aminopolycarboxylic acids such as ethylenediaminetetraacetic acid, diethylenetriamine pentaacetic acid, cyclohexanediaminetetraacetic acid, methyl iminodiacetic acid, 1,3-diaminopropanetetraacetic acid or glycoletherdiaminetetraacetic acid, or organic acids such as citric acid, tartaric acid or malic acid; persulfate; bromic acid salt; permanganate; and nitrobenzene and the like. Among these bleaching agents, complex salts of iron (III) aminopolycarboxylic acid such as iron (III) ethylene diaminetetraacetate complex salt, and persulfate are preferred in view of speedy treatment and reduced environmental contamination and pollution. Furthermore, complex salts of iron (III) aminopolycarboxylic acid are particularly effective in a bleaching solution alone or in a bleach-fixing solution.

The bleach-fixing solution using the complex salts of iron (III) aminopolycarboxylic acid generally has a pH value of about 5.5 to 8.

A bleach accelerating agent can be used in a bleaching solution, bleach-fixing solution and a prebath thereof, if necessary. Specific examples of a bleach accelerating agent are compounds having a mercapto group or a disulfide group, as disclosed in U.S. Pat. No. 3,893,858, West German Pat. Nos. 1,290,812 and 2,059,988, Japanese Patent Application (OPI) Nos. 32736/78, 57831/78, 37418/78, 72623/78, 95630/78, 95631/78, 104232/78, 124424/78,141623/78 and 28426/78, *Research Disclosure,* RD No. 17129 (July, 1978); thiazolidone derivatives as disclosed in Japanese Patent Application (OPI) No. 140129/75; thiourea derivatives as disclosed in Japanese Patent Publication No. 8506/70, Japanese Patent Application (OPI) Nos. 20832/77 and 32735/78, and U.S. Pat. No. 3,706,561; iodide as disclosed in West German Pat. No. 1,127,715 and Japanese Patent Application (OPI) No. 16235/83 polyoxyethylene compounds as disclosed in West German Pat. Nos. 966,410 and 2,748,430; polyamine compounds as disclosed in Japanese Patent Publication No. 8836/70; compounds as disclosed in Japanese Patent Application (OPI) Nos. 42434/74, 59644/74, 94927/78, 35727/79, 26506/80 and 163940/83; and bromide ion. Among these compounds, the compounds as disclosed in U.S. Pat. No. 3,893,858, West German Pat. No. 1,290,812 and Japanese Patent Application (OPI) No. 95630/78 are preferred, since these compounds having a mercapto group or a disulfide group have high accelerating effects. Furthermore, those compounds as disclosed in U.S. Pat. No. 4,552,834 are also preferred. These bleach accelerating agents can be added to a photographic material. These bleach accelerating agents are particularly effective when a color photographic material for photography is bleach-fixed.

The fixing agents include thiosulfate, thiocyanate, thioether compounds, thioureas and iodide used in a large amount. Thiosulfate is commonly used, and in particular, ammonium thiosulfate can most widely be used. The preservatives for a bleach-fixing solution are preferably a sulfite, a bisulfite or an adduct product of carbonyl bisulfite.

It is preferred that the silver halide photographic material of the present invention is processed, after color development, in a bleach-fixing bath without washing with water.

After a silver removing step such as fixing or bleach-fixing, etc., the silver halide photographic material according to the present invention is generally subjected to a water washing step and/or a stabilizing step.

The amount of water required for the water washing step may be selected from a wide range, depending on characteristics of photographic materials (due to elements used therein, for example, couplers, etc.), uses thereof, temperature of washing water, a number of water washing tanks (stages), a replenishment system such as countercurrent or orderly current, etc., or other various conditions. A relationship between a number of water washing tanks and an amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increase in staying time of water in a tank causes propagation of bacteria and some problems such as adhesion of floatage formed on the photographic materials, etc. occur. In the method processing the silver halide color photographic material according to the present invention, a method for reducing amounts of calcium and magnesium as described in U.S. patent application Ser. No. 057,254 can be particularly effectively employed in order to solve such problems. Further, germicides, for example, isothiazolone compounds as described in Japanese Patent Application (OPI) No. 8542/82, thiabendazoles, chlorine type germicides such as sodium chloroisocyanurate, etc., benzotriazoles, germicides as described in Hiroshi Horiguchi, *Bokin-Bobai No Kaqaku,* Sankyo Shuppan (1982), *Biseibutsu No Mekkin-, Sakkin-, Bobai-Gijutsu,* edited by Eiseigijutsu Kai (1982), and *Bokin-Bobaizai Jiten,* edited by Nippon Bokin-Bobai Gakkai (1986), etc., can be employed.

A pH of the washing water used in the processing of the photographic materials according to the present invention is usually from 4 to 9, and preferably from 5 to 8. Temperature of washing water and time for a water washing step can be variously selected, depending on characteristics and uses of the photographic materials. However, it is typical to select a range of from 15° C. to 45° C. and a period from 20 sec. to 10 min., and preferably a range of from 25° C. to 40° C. and a period from 30 sec. to 5 min.

The photographic material of the present invention can also be directly processed with a stabilizing solution in place of the above-described water washing step. As such a stabilizing process, any of known methods as described in Japanese Patent Application (OPI) Nos. 8543/82, 14834/83, 184343/84, 220345/85, 238832/85, 239784/85, 239749/85, 4054/86 and 118749/86, etc., can be employed. Particularly, a stabilizing bath containing 1-hydroxyethylidene-1,1-diphosphonic acid, 5-chloro-2-methyl-4-isothiozolin-3-one, a bismuth compound, or an ammonium compound, etc., is preferably used.

Further, it is possible to conduct the stabilizing process subsequent to the above-described water washing process. One example is a stabilizing bath containing formalin and a surface active agent, which is employed as a final bath in the processing of color photographic materials for photographing.

Now, a rinsing bath or stabilizing bath which can be used in the present invention will be explained in detail.

Between the rinsing bath or stabilizing bath and a bath having a fixing ability, washing with water or rinsing in a short time may be carried out, if desired. The terminology "bath having a fixing ability" means mainly a conventional bleach-fixing or fixing bath, and these baths preferably contain a thiosulfate as described hereinafter.

The above-described rinsing bath is a bath which has the main purpose of washing out the components of the processing solutions adhered to or contained in color photographic materials and the components of the color photographic materials which should be removed therefrom in order to maintain photographic properties and stability of images formed after processing.

Also, the stabilizing bath means a bath having imparted an image stabilizing function which can not be obtained by the rinsing bath in addition to the function of the rinsing bath described above. For example, a bath containing formalin, etc., is illustrated.

The terminology "amount carried over from the preceding bath" means an amount of the preceding bath, which is adhered to or contained in the color photographic material and introduced into the rinsing bath. The amount can be determined by immersing the color photographic material collected just before the introduction thereof to the rinsing bath in water, extracting the components in the preceding bath, and measuring the amount of the components of the preceding bath.

In the rinsing step or stabilizing step in the present invention, it is usually preferred to employ a countercurrent system using two or more stages. The amount of replenishment is typically in a range from 0.5 to 50 times, and preferably from 1.0 to 30 times, of the amount carried over from the preceding bath per unit area of the photographic material. This range is 1/10 or less of the amount of water required for conventional water washing.

Into the rinsing bath or stabilizing bath, various bactericides and antimolds may be incorporated for the purpose of preventing the occurrence of mineral deposit and molds occurring in the photographic material after processing.

For example, one or more of bactericides and antimolds such as thiazolylbenzimidazole type compounds as described in Japanese Patent Application (OPI) Nos. 157244/82 and 105145/83, isothiazolone type compounds as described in Japanese Patent Application (OPI) No. 8542/82, chlorophenol type compounds as represented by trichlorophenol, bromophenol type compounds, organic tin or organic zinc compounds, thiocyanic acid or isothiocyanic acid type compounds, acid amide type compounds, diazine or triazine type compounds, thiourea type compounds, benzotriazole alkylguanidine compounds, quaternary ammonium salts as represented by benzammonium chloride, antibiotics as represented by penicillin, conventional bactericides as described in *J. Antibact. Antifung. Agents,* Vol. 11, No. 5, pages 207 to 223 (1983), etc., may be employed together.

Further, various germicides as described in Japanese Patent Application (OPI) No. 83820/73 may be employed.

Water which is subjected to water softening treatment can be employed as the rinsing solution or the stabilizing solution. The water softening treatment can be carried out by a method using an ion exchange resin or a reverse permeation device.

As an ion exchange resin, a sodium type strongly acidic cationic exchange resin in which a counter ion of an exchange group is a sodium ion is preferred. Also, an H(proton) type strong acidic cationic exchange resin and an ammonium type strong acidic cationic exchange resin may be employed. Further, it is preferred to use an H(proton) type strongly acidic cationic exchange resin together with an OH type strong basic anionic exchange resin. As a resin substratum, a copolymer of styrene, divinylbenzene, etc., is preferred. Particularly, a copolymer in which an amount of divinylbenzene is from 4 to 16% by weight based on the total amount of monomers in the preparation is preferred. Suitable examples of ion exchange resins include Diaion SK-1B, Diaion PK-216 (trademark for product manufactured by Mitsubishi Chemical Industries Ltd.), etc.

Various reverse permeation devices can be employed. A device using a cellulose acetate or polyethersulfone film is suitably employed. A device having pressure of 20 kg/cm$^2$ or less is preferably used because of its low noise.

With the water in which the amount of calcium or magnesium is reduced using an ion exchange resin or a reverse permeation device, the propagation of bacteria or molds is controlled, and thus, preferred results can be achieved by using in combination with the present invention.

It is particularly preferred that a chelating agent is added to the rinsing bath or the stabilizing bath used in the present invention in view of stability of the solution. Suitable examples of chelating agents include inorganic phosphoric acids, aminopolycarboxylic acids, organic phosphoric acids, aminopolyphosphonic acids, phosphonocarboxylic acids, etc.

The present invention is described in detail with reference to the following examples, but the present invention is not to be construed as being limited thereto.

EXAMPLE 1

Sample 101:

On a cellulose triacetate film support having a subbing layer, each layer having the composition shown below was coated to prepare a multilayer color photographic material which was designated Sample 101.

In the following, the coated amounts of sensitizing dyes are shown by mol number per mol of silver halide in the same layer.

| | |
|---|---|
| **First Layer: Antihalation Layer:** | |
| Black Colloidal Silver | 0.2 g/m$^2$ |
| Gelatin | 1.3 g/m$^2$ |
| Colored Coupler C-1 | 0.06 g/m$^2$ |
| Ultraviolet Ray Absorbing Agent UV-1 | 0.1 g/m$^2$ |
| Ultraviolet Ray Absorbing Agent UV-2 | 0.2 g/m$^2$ |
| High Boiling Point Organic Solvent Oil-1 | 0.01 ml/m$^2$ |
| High Boiling Point Organic Solvent Oil-2 | 0.01 ml/m$^2$ |
| **Second Layer: Intermediate Layer:** | |
| Fine Grain Silver Bromide (average grain size: 0.07 μm) | 0.15 g/m$^2$ |
| Gelatin | 1.0 g/m$^2$ |
| Colored Coupler C-2 | 0.02 g/m$^2$ |
| High Boiling Point Organic Solvent Oil-1 | 0.1 ml/m$^2$ |
| **Third Layer: Low-Sensitive Red-Sensitive Emulsion Layer:** | |
| Silver Iodobromide Emulsion (silver iodide: 2 mol %, average grain size: 0.3 μm) | 0.4 g/m$^2$ (as silver) |
| Gelatin | 0.6 g/m$^2$ |
| Sensitizing Dye I | $1.0 \times 10^{-4}$ |
| Sensitizing Dye II | $3\ 0 \times 10^{-4}$ |
| Sensitizing Dye III | $1 \times 10^{-5}$ |
| Coupler C-3 | 0.06 g/m$^2$ |
| Coupler C-4 | 0.06 g/m$^2$ |
| Coupler C-8 | 0.04 g/m$^2$ |
| Coupler C-2 | 0.03 g/m$^2$ |
| High Boiling Point Organic Solvent Oil-1 | 0.03 ml/m$^2$ |
| High Boiling Point Organic Solvent Oil-3 | 0.012 ml/m$^2$ |
| **Fourth Layer: Medium-Sensitive Red-Sensitive Emulsion Layer:** | |
| Silver Iodobromide Emulsion (silver iodide: 5 mol %, average grain size: 0.5 μm) | 0.7 g/m$^2$ (as silver) |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 g/m$^2$ |
| Coupler C-4 | 0.24 g/m$^2$ |
| Coupler C-8 | 0.04 g/m$^2$ |
| Coupler C-2 | 0.04 g/m$^2$ |
| High Boiling Point Organic Solvent Oil-1 | 0.15 ml/m$^2$ |
| High Boiling Point Organic Solvent Oil-3 | 0.02 ml/m$^2$ |
| **Fifth Layer: High-Sensitive Red-Sensitive Emulsion Layer:** | |
| Silver Iodobromide Emulsion (silver iodide: 10 mol %, average grain size: 0.7 μm) | 1.0 g/m$^2$ (as silver) |
| Gelatin | 1.0 g/m$^2$ |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 g/m$^2$ |
| Coupler C-7 | 0.1 g/m$^2$ |
| High Boiling Point Organic Solvent Oil-1 | 0.01 ml/m$^2$ |
| High Boiling Point Organic Solvent Oil-2 | 0.05 ml/m$^2$ |

-continued

| | |
|---|---|
| **Sixth Layer: Intermediate Layer:** | |
| Gelatin | 1.0 g/m$^2$ |
| Compound Cpd-A | 0.03 g/m$^2$ |
| High Boiling Point Organic Solvent Oil-1 | 0.05 ml/m$^2$ |
| **Seventh Layer: Low-Sensitive Green-Sensitive Emulsion Layer:** | |
| Silver Iodobromide Emulsion (silver iodide: 4 mol %, average grain size: 0.3 μm) | 0.30 g/m$^2$ (as silver) |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Gelatin | 1.0 g/m$^2$ |
| Coupler C-9 | 0.2 g/m$^2$ |
| Coupler C-5 | 0.03 g/m$^2$ |
| Coupler C-1 | 0.03 g/m$^2$ |
| High Boiling Point Organic Solvent Oil-1 | 0.5 ml/m$^2$ |
| **Eighth Layer: Medium-Sensitive Green-Sensitive Emulsion Layer:** | |
| Silver Iodobromide Emulsion (silver iodide: 5 mol %, average grain size: 0.5 μm) | 0.4 g/m$^2$ (as silver) |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Coupler C-9 | 0.25 g/m$^2$ |
| Coupler C-1 | 0.03 g/m$^2$ |
| Coupler C-10 | 0.015 g/m$^2$ |
| Coupler C-5 | 0.01 g/m$^2$ |
| High Boiling Point Organic Solvent Oil-1 | 0.2 ml/m$^2$ |
| **Ninth Layer: High-Sensitive Green-Sensitive Emulsion Layer:** | |
| Silver Iodobromide Emulsion (silver iodide: 6 mol %, average grain size: 0.7 μm) | 0.85 g/m$^2$ (as silver) |
| Gelatin | 1.0 g/m$^2$ |
| Sensitizing Dye VII | $3.5 \times 10^{-4}$ |
| Sensitizing Dye VIII | $1.4 \times 10^{-4}$ |
| Coupler C-11 | 0.01 g/m$^2$ |
| Coupler C-12 | 0.03 g/m$^2$ |
| Coupler C-13 | 0.20 g/m$^2$ |
| Coupler C-1 | 0.02 g/m$^2$ |
| Coupler C-15 | 0.02 g/m$^2$ |
| High Boiling Point Organic Solvent Oil-1 | 0.20 ml/m$^2$ |
| High Boiling Point Organic Solvent Oil-2 | 0.05 ml/m$^2$ |
| **Tenth Layer: Yellow Filter Layer:** | |
| Gelatin | 1.2 g/m$^2$ |
| Yellow Colloidal Silver | 0.08 g/m$^2$ |
| Compound Cpd-B | 0.1 g/m$^2$ |
| High Boiling Point Organic Solvent Oil-1 | 0.3 ml/m$^2$ |
| **Eleventh Layer: Low-Sensitive Blue-Sensitive Emulsion Layer:** | |
| Monodispersed Silver Iodobromide Emulsion (silver iodide: 4 mol %, average grain size: 0.3 μm) | 0.4 g/m$^2$ (as silver) |
| Gelatin | 1.0 g/m$^2$ |
| Sensitizing Dye IX | $2 \times 10^{-4}$ |
| Coupler C-14 | 0.9 g/m$^2$ |
| Coupler C-5 | 0.07 g/m$^2$ |
| High Boiling Point Organic Solvent Oil-1 | 0.2 ml/m$^2$ |
| **Twelfth Layer: High-Sensitive Blue-Sensitive Emulsion Layer:** | |
| Silver Iodobromide Emulsion (silver iodide: 10 mol %, average grain size: 1.5 μm) | 0.5 g/m$^2$ (as silver) |
| Gelatin | 0.6 g/m$^2$ |
| Sensitizing Dye IX | $1 \times 10^{-4}$ |
| Coupler C-14 | 0.25 g/m$^2$ |
| High Boiling Point Organic Solvent Oil-1 | 0.07 ml/m$^2$ |
| **Thirteenth Layer: First Protective Layer:** | |
| Gelatin | 0.8 g/m$^2$ |
| Ultraviolet Ray Absorbing Agent UV-1 | 0.1 g/m$^2$ |
| Ultraviolet Ray Absorbing Agent UV-2 | 0.2 g/m$^2$ |
| High Boiling Point Organic Solvent Oil-1 | 0.01 ml/m$^2$ |
| High Boiling Point Organic Solvent Oil-2 | 0.01 ml/m$^2$ |
| **Fourteenth Layer: Second Protective Layer:** | |
| Fine Grain Silver Bromide (average grain size: 0.07 μm) | 0.5 g/m$^2$ |
| Gelatin | 0.45 g/m$^2$ |
| Polymethyl Methacrylate Particles (diameter: 1.5 μm) | 0.2 g/m$^2$ |
| Hardening Agent H-1 | 0.4 g/m$^2$ |
| Formaldehyde Scavenger S-1 | 0.5 g/m$^2$ |
| Formaldehyde Scavenger S-2 | 0.5 g/m$^2$ |

Each layer described above further contained a surface active agent as a coating aid in addition to the above described components. Thus, Sample 101 was prepared.

Samples 102 to 110:

Samples 102 to 110 were prepared in the same manner as described for Sample 101 except using an equimolar amount of couplers as described in Table 1 shown below in place of Coupler C-3 used in the third layer and the fourth layer of Sample 101, respectively.

The compounds used in this example are shown below by chemical structure or chemical name:

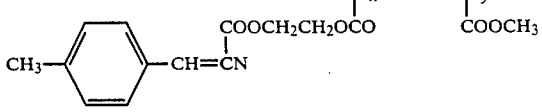

x/y = 7/3 (by weight ratio)

UV-1

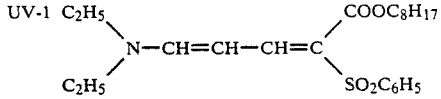

Tricresyl phosphate

Oil-1

Dibutyl phthalate

Bis(2-ethylhexyl)phthalate

-continued
C-1
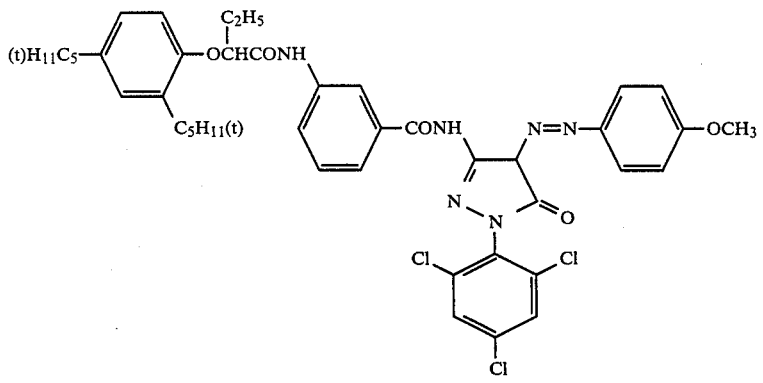
C-2
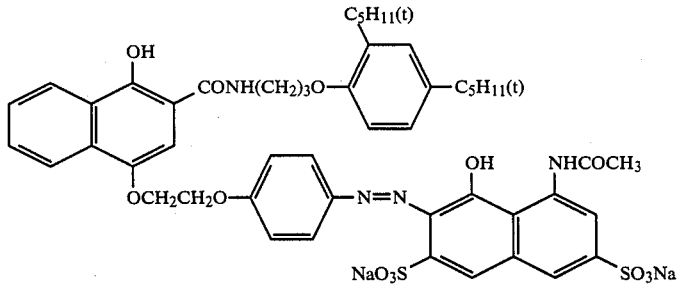
C-3
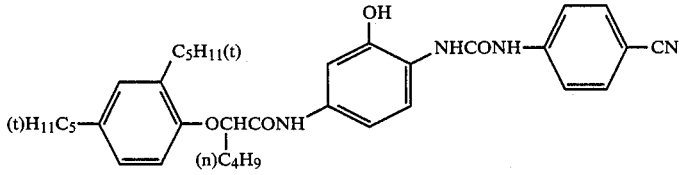
C-4
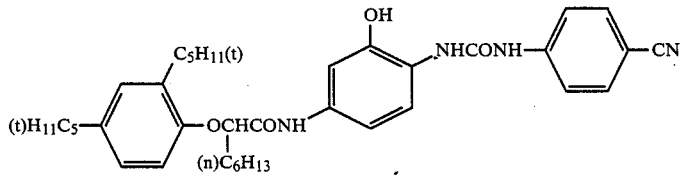
C-5
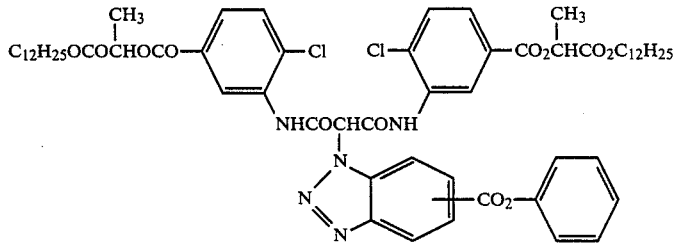

-continued
C-6
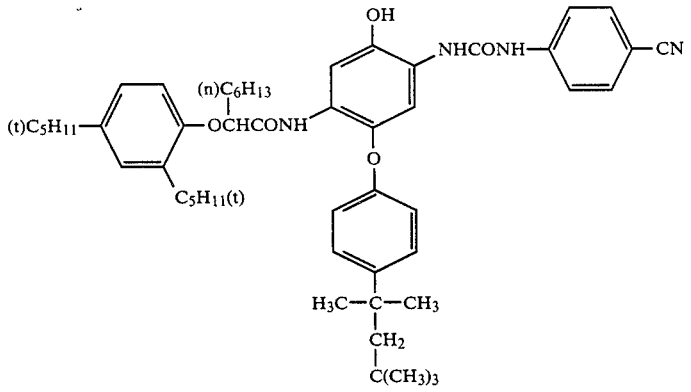
C-7
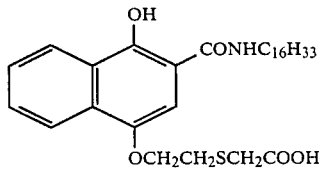
C-8
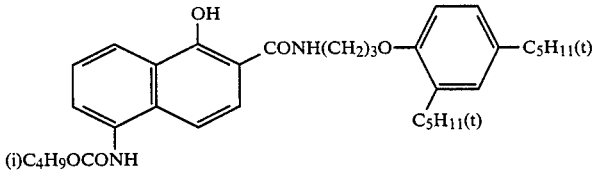
C-9
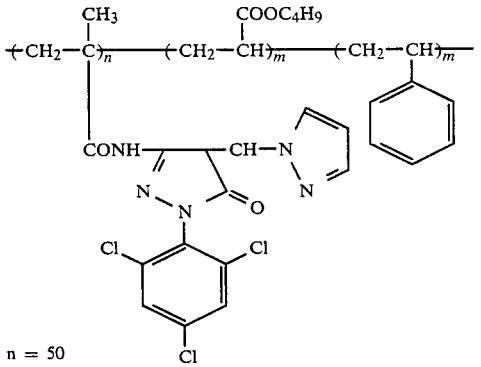
n = 50
m = 25
m′ = 25 (by weight)
mol. wt. about 20,000
C-10
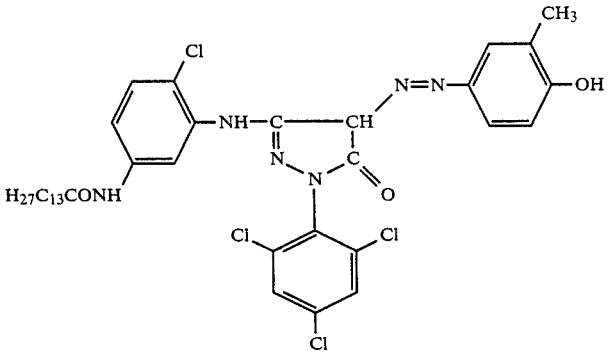

-continued
C-11
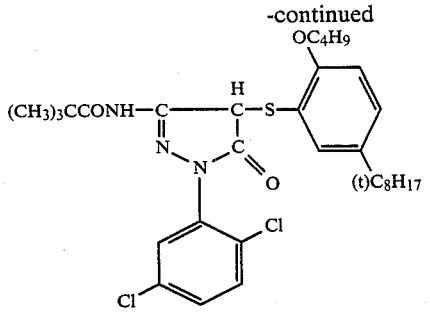
C-12
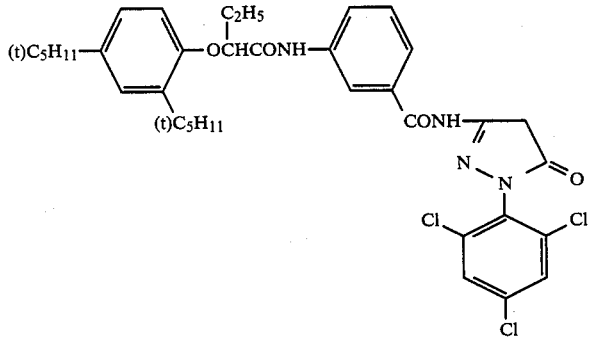
C-13
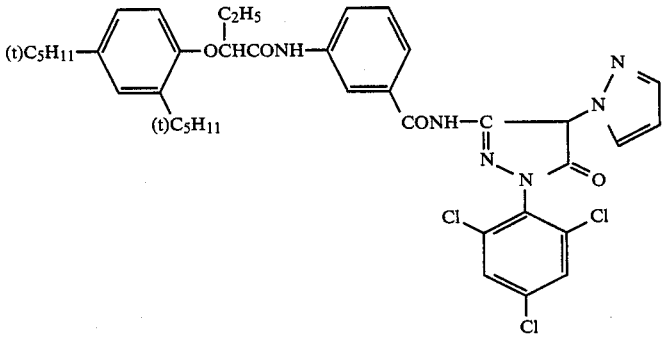
C-14
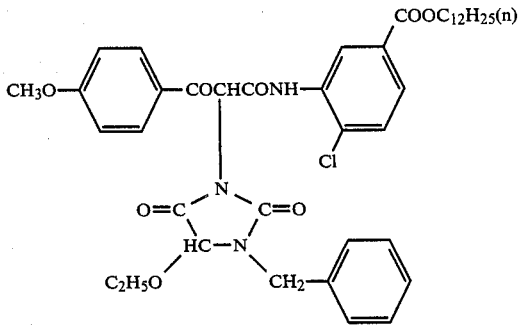
C-15
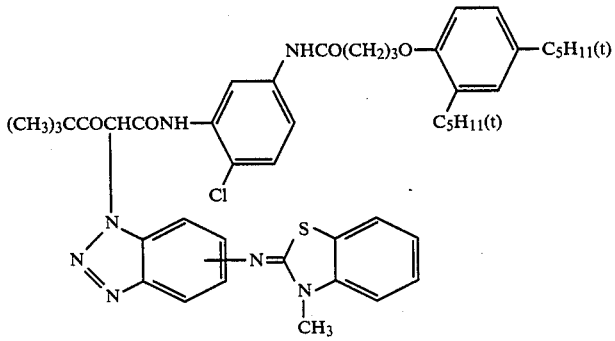

-continued
Cpd A
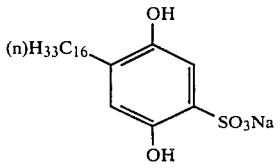
Cpd B
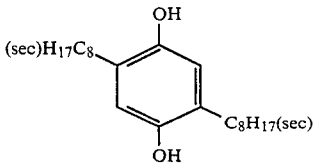
Sensitizing Dye I
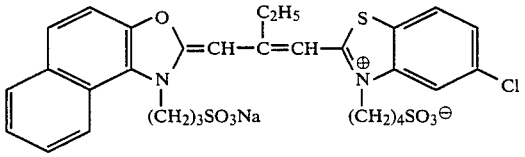
Sensitizing Dye II
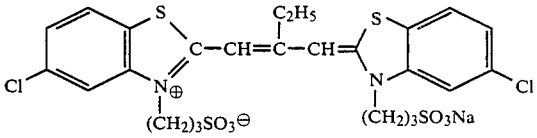
Sensitizing Dye III
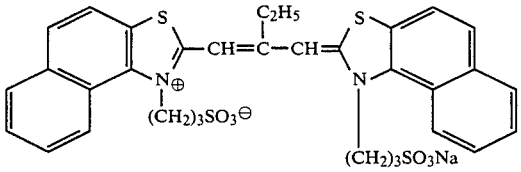
Sensitizing Dye IV
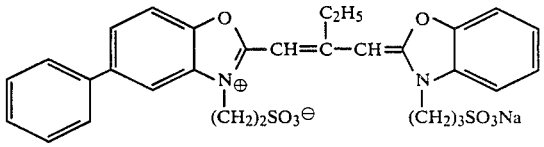
Sensitizing Dye V
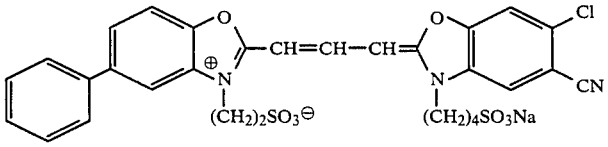
Sensitizing Dye VI
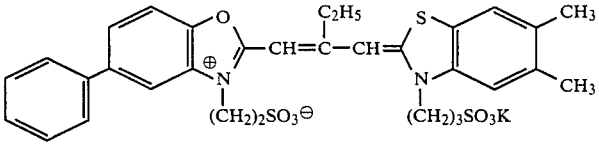
Sensitizing Dye VII
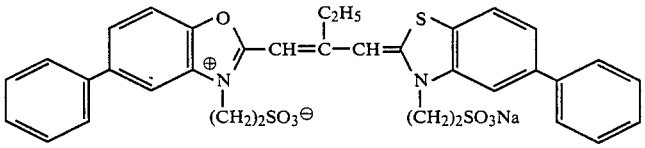
Sensitizing Dye VIII
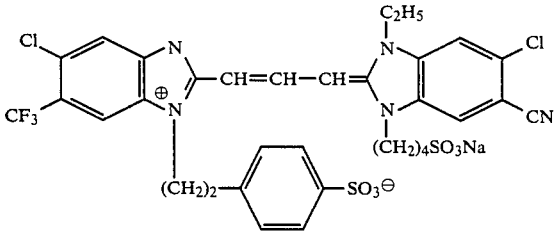
Sensitizing Dye IX
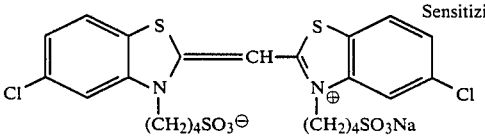
H-1
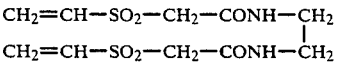

-continued

S-1

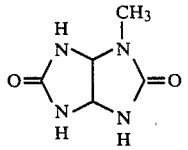

S-2

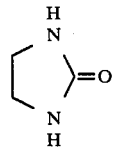

Samples 101 to 110 were cut into strips of a 35 mm width, exposed to gray light, and subjected to a running test according to Processing Steps (I), (II) or (III) shown below with a 500 m length. After the running test, samples 101 to 110 were exposed to white light of 20 CMS (candle-meter-seconds) and then subjected to the development processing shown below.

Processing Step (I): [Processing Temperature: 38° C.]

| Processing Step | Processing Time | Amount of Replenishment* |
|---|---|---|
| Color Development | 3 min. 15 sec. | 15 ml |
| Bleaching | 3 min. 00 sec. | 5 ml |
| Fixing | 4 min. 00 sec. | 30 ml |
| Stabilizing (1) | 30 sec. | — |
| Stabilizing (2) | 30 sec. | — |
| Stabilizing (3) | 30 sec. | 30 ml |
| Drying | 1 min. 30 sec. (at 50° C.) | — |

*Amount of replenishment per 1 meter of a 35 mm width strip

In the above described processing steps, the stabilizing steps (1), (2) and (3) were carried out using a counterurrent stabilizing system of (3)→(2)→(1). Further, the amount of fixing solution carried over to the stabilizing tank was 2 ml per meter of the strip.

The composition of each processing solution used is illustrated below.

| | Mother Solution | Replenisher |
|---|---|---|
| Color Developing Solution: | | |
| Diethylenetriaminepenta-acetic Acid | 1.0 g | 2.0 g |
| 1-Hydroxyethylidene-1,1-diphosphonic Acid | 2.0 g | 3.3 g |
| Sodium Sulfite | 4.0 g | 5.0 g |
| Potassium Carbonate | 30.0 g | 38.0 g |
| Potassium Bromide | 1.4 g | — |
| Potassium Iodide | 1.3 mg | — |
| Hydroxylamine | 2.4 g | 3.2 g |
| 4-(N—Ethyl-N—β-hydroxy-ethylamino)-2-methyl-aniline Sulfate | 4.5 g | 7.2 g |
| Water to make | 1 l | 1 l |
| pH | 10.00 | 10.05 |
| Bleaching Solution: | | |
| Iron (III) Ammonium Ethylenediaminetetra-acetate | 50 g | 60 g |
| Iron (III) Ammonium 1,3-Diaminopropanetetra-acetate | 60 g | 72 g |
| Ammonium Nitrate | 10.0 g | 12.0 g |
| Ammonium Bromide | 150 g | 170 g |
| Water to make | 1 l | 1 l |
| pH | 6.0 | 5.8 |
| Fixing Solution: | | |
| Disodium Ethylenediamine-tetraacetate | 1.0 g | 1.2 g |
| Sodium Sulfite | 4.0 g | 5.0 g |
| Sodium Bisulfite | 4.6 g | 5.8 g |
| Ammonium Thiosulfate (70% aq. soln.) | 175 ml | 200 ml |
| Water to make | 1 l | 1 l |
| pH | 6.6 | 6.6 |

-continued

| | Mother Solution | Replenisher |
|---|---|---|
| Stabilizing Solution: | | |
| Formalin (37% w/v) | 2.0 ml | 3.0 ml |
| Polyoxyethylene-p-monononylphenylether (average degree of polymerization: 10) | 0.3 g | 0.45 g |
| 5-Chloro-2-methyl-4-iso-thiazolin-3-one | 0.03 g | 0.045 g |
| Water to make | 1 l | 1 l |

Processing Step (II): [Processing Temperature: 38° C.]

| Processing Step | Processing Time | Amount of Replenishment* |
|---|---|---|
| Color Development | 3 min. 15 sec. | 15 ml |
| Bleaching | 1 min. 00 sec. | 10 ml |
| Bleach-Fixing | 3 min. 15 sec. | 15 ml |
| Washing with Water (1) | 40 sec. | — |
| Washing with Water (2) | 1 min. 00 sec. | 1200 ml |
| Stabilizing | 20 sec. | 15 ml |
| Drying | 1 min. 15 sec. (at 60° C.) | — |

*Amount of replenishment per 1 meter of a 35 mm width strip

In the above described processing steps, the washing with water steps were carried out using a countercurrent water washing system from Washing with Water (2) to Washing with Water (1).

The composition of each processing solution used is set forth below.

| Color Developing Solution: | Mother Solution | Replenisher |
|---|---|---|
| Diethylenetriaminepenta-acetic Acid | 1.0 g | 1.1 g |
| 1-Hydroxyethylidene-1,1-diphosphonic Acid | 2.0 g | 2.2 g |
| Sodium Sulfite | 4.0 g | 4.9 g |
| Potassium Carbonate | 30.0 g | 42.0 g |
| Potassium Bromide | 1.6 g | — |
| Potassium Iodide | 2.0 mg | — |
| Hydroxylamine | 2.4 g | 3.6 g |
| 4-(N—Ethyl-N—β-hydroxy-ethylamino)-2-methyl-aniline Sulfate | 5.0 g | 7.3 g |
| Water to make | 1.0 liter | 1.0 liter |
| pH | 10.00 | 10.05 |

| Bleaching Solution: (both Mother Solution and Replenisher) | |
|---|---|
| Iron (III) Ammonium Ethylene-diaminetetraacetate | 120.0 g |
| Disodium Ethylenediaminetetra-acetate | 10.0 g |
| Ammonium Nitrate | 10.0 g |
| Ammonium Bromide | 100.0 g |
| Adjusted pH to 6.3 with aqueous ammonia | |
| Water to make | 1.0 liter |
| Bleach-Fixing Solution: (both Mother Solution and Replenisher) | |
| Iron (III) Ammonium Ethylene- | 50.0 g |

-continued

| | |
|---|---|
| diaminetetraacetate | |
| Disodium Ethylenediaminetetra-acetate | 5.0 g |
| Sodium Sulfite | 12.0 g |
| Aqueous Solution of Ammonium Thiosulfate (70%) adjusted pH to 7.3 with aqueous ammonia | 240.0 ml |
| Water to make | 1.0 liter |

Washing Water:

City water which was passed through a column filled with a Na type strongly acidic cation exchange resin (Diaion SK-1B manufactured by Mitsubishi Chemical Industries Ltd.) to prepare water having calcium: 2 mg/l and magnesium: 1.2 mg/l was employed.

Stabilizing Solution:

Same as described in Processing Step (I).

Processing Step (III): [Processing Temperature: 38° C.]

| Processing Step | Processing Time | Capacity of Tank | Amount of Replenishment* |
|---|---|---|---|
| Color Development | 3 min. 15 sec. | 8 l | 15 ml |
| Bleach-Fixing | 2 min. 30 sec. | 8 l | 25 ml |
| Washing With Water (1) | 20 sec. | 4 l | Three-stage countercurrent system |
| Washing With Water (2) | 20 sec. | 4 l | |
| Washing With Water (3) | 20 sec. | 4 l | 10 ml |
| Stabilizing | 20 sec. | 4 l | 10 ml |

*Amount of replenishment per 1 meter of a 35 mm width strip

In the above described processing steps, the washing with water steps (1), (2) and (3) were carried out using a three-stage countercurrent washing with water system of (3)→(2)→(1).

The composition of each processing solution used is illustrated below.

| | Mother Solution | Replen-isher |
|---|---|---|
| Color Developing Solution: | | |
| Diethylenetriaminepenta-acetic Acid | 1.0 g | 1. g |
| 1-Hydroxyethylidene-1,1-diphosphonic Acid | 2.0 g | 2.4 g |
| Sodium Sulfite | 2.0 g | 4.8 g |
| Potassium Carbonate | 35.0 g | 45.0 g |
| Potassium Bromide | 1.6 g | — |
| Potassium Iodide | 2.0 mg | — |
| Hydroxylamine | 2.0 g | 3.6 g |
| 4-(N—Ethyl-N—β-hydroxy-ethylamino)-2-methyl-aniline Sulfate | 5.0 g | 7.5 g |
| Water to make | 1 liter | 1 liter |
| Adjusted pH with potassium hydroxide to | 10.20 | 10.35 |
| Bleach-Fixing Solution: | | |
| Iron (III) Ammonium Ethylenediaminetetra-acetate | 40 g | 45 g |
| Iron (III) Ammonium Diethylenetriaminepenta-acetate | 40 g | 45 g |
| Disodium Ethylenediamine-tetraacetate | 10 g | 10 g |
| Sodium Sulfite | 15 g | 20 g |
| Ammonium Thiosulfate (70% w/v aq. soln.) | 240 ml | 270 ml |
| Aqueous Ammonia (26%) | 14 ml | 12 ml |
| Water to make | 1 l | 1 l |
| pH | 6.7 | 6.5 |

-continued

| | Mother Solution | Replen-isher |
|---|---|---|
| Washing Water: | | |
| The following three kinds of washing water were employed. | | |
| [1] City Water | | |
| Calcium | 26 mg/l | |
| Magnesium | 9 mg/l | |
| pH | 7.2 | |
| [2] Ion Exchanged Water | | |
| The above described city water was treated with a Na type strongly acidic cation exchange resin manufactured by Mitsubishi Chemical Industries Ltd. to prepare water having the water quality as follows: | | |
| Calcium | 1.1 mg/l | |
| Magnesium | 0.5 mg/l | |
| pH | 6.6 | |
| [3] City Water Containing Chelating Agent | | |
| To the above described city water, was added disodium ethylenediaminetetraacetate in an amount of 500 mg per liter. | | |
| pH | 6.7 | |
| Stabilizing Solution: | | |
| Same as described in Processing Step (I). | | |

The amount of remaining silver in each sample thus-processed was determined according to fluorescent X-rays analysis. The results obtained are shown in Table 1 below.

TABLE 1

| Sample No. | Coupler Used in Third Layer and Fourth Layer | Amount of Remaining Silver: Processing Step (I) (mg/m²) | Processing Step (II) (mg/m²) | Processing Step (III) (mg/m²) |
|---|---|---|---|---|
| 101 (Control) | C-3 | 45 | 48 | 52 |
| 102 (Comparison) | Comparative Coupler A | 32 | 34 | 36 |
| 103 (Comparison) | Comparative Coupler B | 31 | 34 | 37 |
| 104 (Comparison) | Comparative Coupler C | 35 | 37 | 40 |
| 105 (Comparison) | Comparative Coupler D | 34 | 38 | 42 |
| 106 (Present Invention) | Compound (2) | 13 | 16 | 19 |
| 107 (Present Invention) | Compound (3) | 10 | 14 | 18 |
| 108 (Present Invention) | Compound (17) | 13 | 15 | 18 |
| 109 (Present Invention) | Compound (21) | 12 | 14 | 16 |
| 110 (Present Invention) | Compound (22) | 14 | 16 | 17 |

Comparative Coupler A:
(The compound as described in Research Disclosure, RD No. 11449 (1973))

-continued

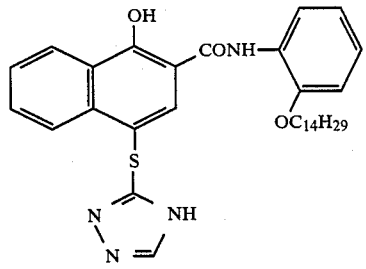

Comparative Coupler B:
(The compound as described in
Research Disclosure, RD No. 11449 (1973))

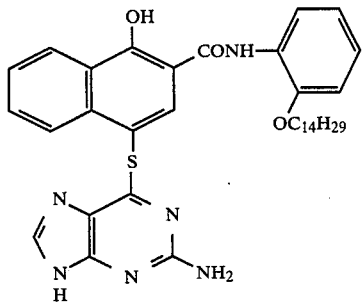

Comparative Coupler C:
(The compound as described in
Japanese Patent Application (OPI) No. 201247/86)

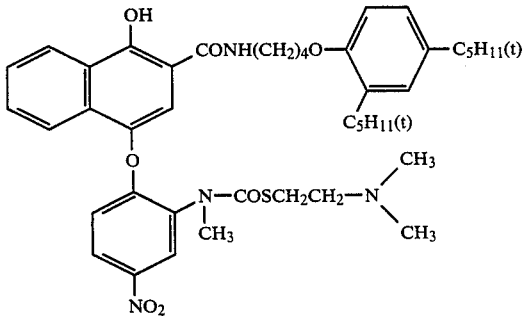

Comparative Coupler D:
(The compound described in
Japanese Patent Application (OPI) No. 201247/86)

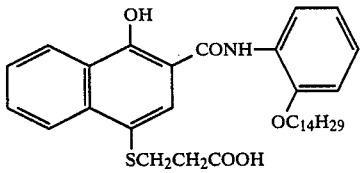

It is apparent from the results shown in Table 1 that the color photographic materials in which the couplers according to the present invention are employed exhibit a sufficient bleach accelerating effect under a running condition. Further, it is known that a severe degradation on color reproducibility and/or gradation alance is observed in practical use when the amount of silver remaining exceeds 30 mg/m$^2$. As can be seen from the results shown above, the amount of silver remaining is within a range which is no practical problem by using the compound according to the present invention even in a rapid processing.

EXAMPLE 2

Sample 201:

In a manner similar to that described in Example 1, each layer having the composition shown below was coated on a support to prepare a multilayer photographic material which was designated Sample 201.

In the following, the coated amounts of sensitizing dyes are shown by mol number per mol of silver halide in the same layer.

| | |
|---|---|
| First Layer: Antihalation Layer: | |
| Black Colloidal Silver | 0.2 g/m$^2$ |
| Gelatin | 1.0 g/m$^2$ |
| Ultraviolet Ray Absorbing Agent UV-3 | 0.2 g/m$^2$ |
| High Boiling Point Organic Solvent Oil-4 | 0.02 ml/m$^2$ |
| Second Layer: Intermediate Layer: | |
| Fine Grain Silver Bromide (average grain size 0.07 μm) | 0.15 g/m$^2$ |
| Gelatin | 1.0 g/m$^2$ |
| Third Layer: Low-Sensitive Red-Sensitive Emulsion Layer: | |
| Silver Iodobromide Emulsion (silver iodide: 2 mol %, average grain size: 0.3 μm) | 1.5 g/m$^2$ |
| Gelatin | 0.9 g/m$^2$ |
| Sensitizing Dye A | $1.0 \times 10^{-4}$ |
| Sensitizing Dye B | $2.0 \times 10^{-4}$ |
| Coupler D-1 | 0.6 g/m$^2$ |
| Coupler D-2 | 0.2 g/m$^2$ |
| Coupler D-3 | 0.02 g/m$^2$ |
| Coupler D-4 | 0.01 g/m$^2$ |
| High Boiling Point Organic Solvent Oil-4 | 0.1 ml/m$^2$ |
| High Boiling Point Organic Solvent Oil-5 | 0.1 ml/m$^2$ |
| Fourth Layer: High-Sensitive Red-Sensitive Emulsion Layer: | |
| Monodispersed Silver Iodobromide Emulsion (silver iodide: 5 mol %, average grain size: 0.7 μm) | 1.2 g/m$^2$ |
| Gelatin | 1.0 g/m$^2$ |
| Sensitizing Dye A | $3 \times 10^{-4}$ |
| Sensitizing Dye B | $2 \times 10^{-4}$ |
| Coupler D-1 | 0.10 g/m$^2$ |
| Coupler D-2 | 0.03 g/m$^2$ |
| Coupler D-5 | 0.01 g/m$^2$ |
| Coupler D-4 | 0.02 g/m$^2$ |
| Coupler D-3 | 0.02 g/m$^2$ |
| High Boiling Point Organic Solvent Oil 5 | 0.1 ml/m$^2$ |
| Fifth Layer: Intermediate Layer: | |
| Gelatin | 1.0 g/m$^2$ |
| Compound Cpd-C | 0.05 g/m$^2$ |
| High Boiling Point Organic Solvent Oil-5 | 0.05 ml/m$^2$ |
| Sixth Layer: Low-Sensitive Green-Sensitive Emulsion Layer: | |
| Monodispersed Silver Iodobromide Emulsion (silver iodide: 3 mol %, average grain size: 0.3 μm) | 0.6 g/m$^2$ |
| Monodispersed Silver Iodobromide Emulsion (silver iodide: 6 mol %, average grain size: 0.5 μm) | 0.7 g/m$^2$ |
| Gelatin | 1.0 g/m$^2$ |
| Sensitizing Dye C | $3 \times 10^{-4}$ |
| Sensitizing Dye D | $2 \times 10^{-4}$ |
| Coupler D-6 | 0.4 g/m$^2$ |
| Coupler D-7 | 0.1 g/m$^2$ |
| Coupler D-8 | 0.02 g/m$^2$ |
| Coupler D-9 | 0.01 g/m$^2$ |
| High Boiling Point Organic | 0.05 ml/m$^2$ |

-continued

| | |
|---|---|
| Solvent Oil-5 | |
| Seventh Layer: High-Sensitive Green-Sensitive Emulsion Layer: | |
| Polydispersed Silver Iodobromide Emulsion (silver iodide: 7 mol %, average grain size: 0.8 μm) | 0.8 g/m$^2$ |
| Gelatin | 0.9 g/m$^2$ |
| Sensitizing Dye C | $2 \times 10^{-4}$ |
| Sensitizing Dye D | $1.5 \times 10^{-4}$ |
| Coupler D-6 | 0.08 g/m$^2$ |
| Coupler D-7 | 0.05 g/m$^2$ |
| Coupler D-9 | 0.02 g/m$^2$ |
| High Boiling Point Organic Solvent Oil-4 | 0.08 ml/m$^2$ |
| High Boiling Point Organic Solvent Oil-6 | 0.03 ml/m$^2$ |
| Eighth Layer: Intermediate Layer: | |
| Gelatin | 1.2 g/m$^2$ |
| Compound Cpd-C | 0.6 g/m$^2$ |
| High Boiling Point Organic Solvent Oil-4 | 0.3 ml/m$^2$ |
| Ninth Layer: Yellow Filter Layer: | |
| Yellow Colloidal Silver | 0.1 g/m$^2$ |
| Gelatin | 0.8 g/m$^2$ |
| Compound Cpd-C | 0.2 g/m$^2$ |
| High Boiling Point Organic Solvent Oil-4 | 0.1 g/m$^2$ |
| Tenth Layer: Low-Sensitive Blue-Sensitive Emulsion Layer: | |
| Monodispersed Silver Iodobromide Emulsion (silver iodide: 6 mol %, average grain size: 0.3 μm) | 0.3 g/m$^2$ |
| Monodispersed Silver Iodobromide Emulsion (silver iodide: 5 mol %, average grain size: 0.6 μm) | 0.3 g/m$^2$ |
| Gelatin | 1.0 g/m$^2$ |
| Sensitizing Dye E | $1 \times 10^{-4}$ |
| Sensitizing Dye F | $1 \times 10^{-4}$ |
| Coupler D-10 | 0.9 g/m$^2$ |
| Coupler D-4 | 0.05 g/m$^2$ |
| High Boiling Point Organic Solvent Oil-6 | 0.01 ml/m$^2$ |
| Eleventh Layer: High-Sensitive Blue-Sensitive Emulsion Layer: | |
| Monodispersed Silver Iodobromide Emulsion (silver iodide: 8 mol %, average grain size: 1.5 μm) | 0.7 g/m$^2$ |
| Gelatin | 0.5 g/m$^2$ |
| Sensitizing Dye E | $5 \times 10^{-4}$ |
| Sensitizing Dye F | $5 \times 10^{-4}$ |
| Coupler D-10 | 0.2 g/m$^2$ |
| Coupler D-4 | 0.05 g/m$^2$ |
| High Boiling Point Organic Solvent Oil-6 | 0.01 ml/m$^2$ |
| Twelfth Layer: First Protective Layer: | |
| Gelatin | 0.5 g/m$^2$ |
| Fine Grain Silver Bromide (average grain size 0.07 μm) | 0.33 g/m$^2$ |
| Coupler D-11 | 0.1 g/m$^2$ |
| Ultraviolet Ray Absorbing Agent UV-4 | 0.1 g/m$^2$ |
| Ultraviolet Ray Absorbing Agent UV-5 | 0.2 g/m$^2$ |
| High Boiling Point Organic Solvent Oil-6 | 0.01 ml/m$^2$ |
| Thirteenth Layer: Second Protective Layer: | |
| Gelatin | 0.8 g/m$^2$ |
| Polymethyl Methacrylate Particles (diameter: 1.5 μm) | 0.2 g/m$^2$ |
| Formaldehyde Scavenger S-3 | 0.5 g/m$^2$ |

Further, Surface Active Agent W-1, and Hardening Agent H-2 were added.

Samples 202 to 210:

Samples 202 to 210 were prepared in the same manner as described for Sample 201 except using an equimolar amount of couplers as described in Table 2 shown below in place of Coupler D-1 used in the third layer and the fourth layer of Sample 201, respectively.

Samples 211 to 215:

Samples 211 to 215 were prepared in the same manner as described for Sample 201 except using an equimolar amount of couplers as described in Table 2 shown below in place of Coupler D-6 used in the sixth layer and the seventh layer of Sample 201, respectively.

The compounds used in this example are shown below by chemical structure:

Coupler D-1

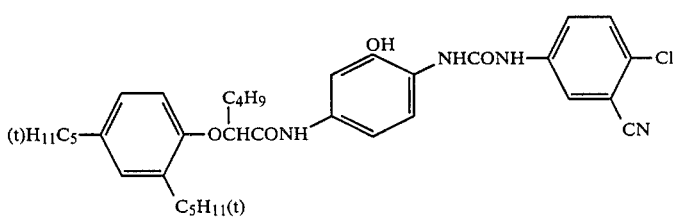

Coupler D-2

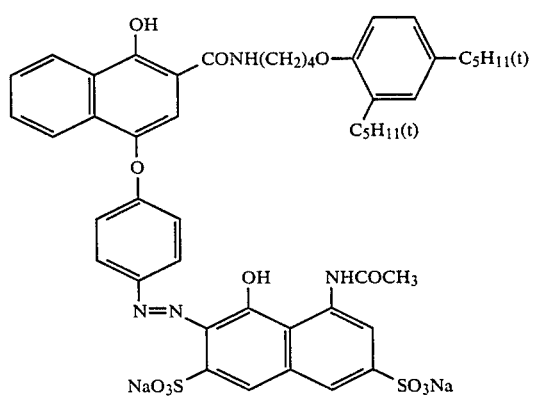

-continued
Coupler D-3
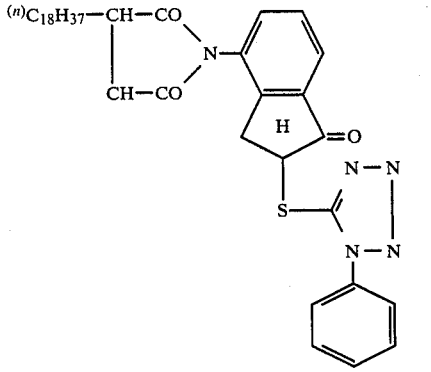
Coupler D-4
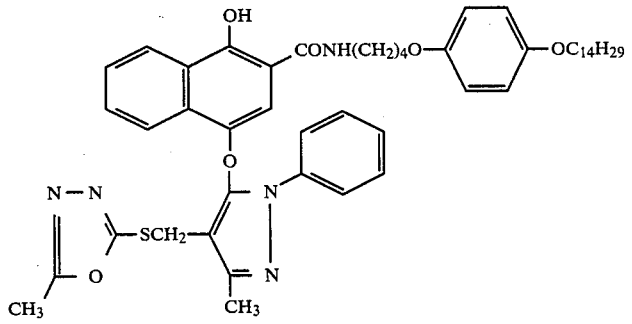
Coupler D-5
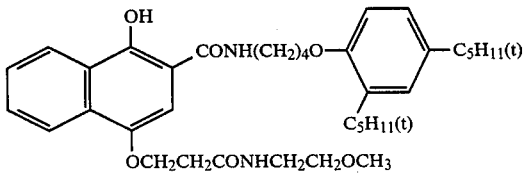
Coupler D-6
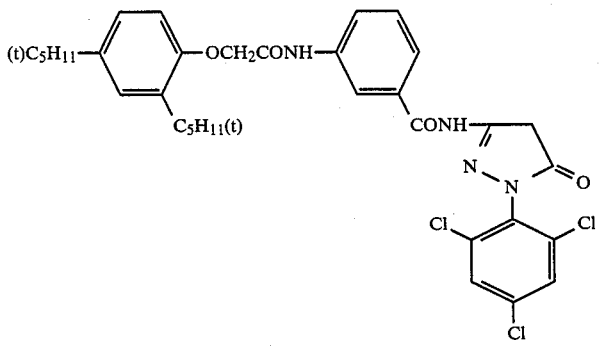
Coupler D-7
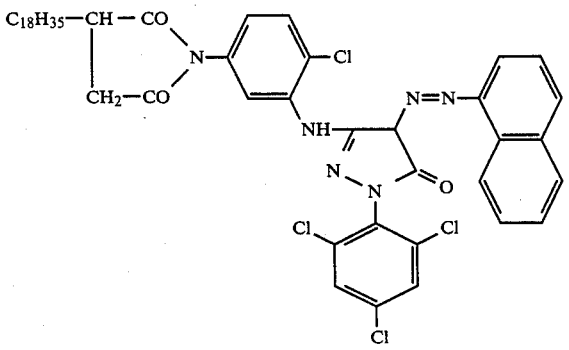

-continued
Coupler D-8
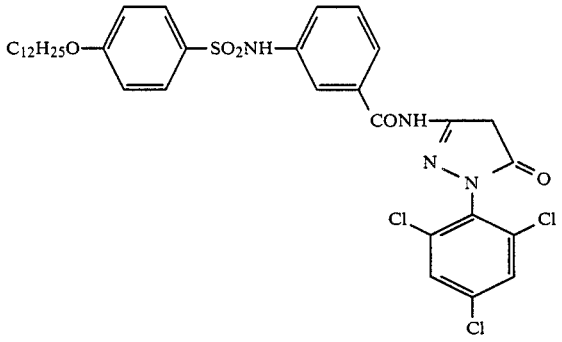
Coupler D-9
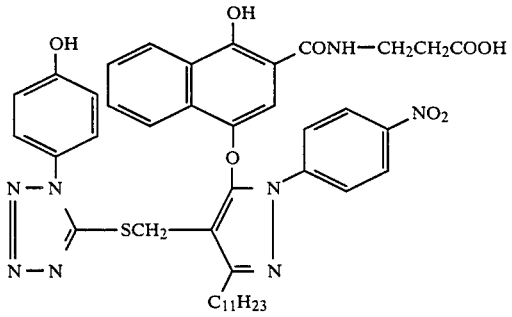
Coupler D-10
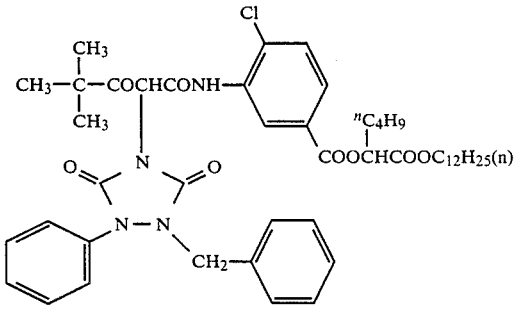
Coupler D-11
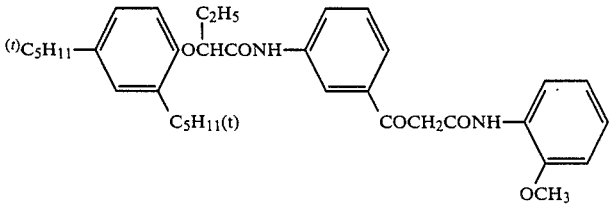
Surface Active Agent W-1
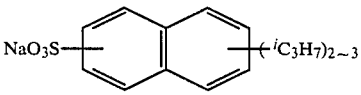
Formaldehyde Scavenger S-3
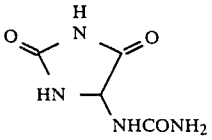

-continued
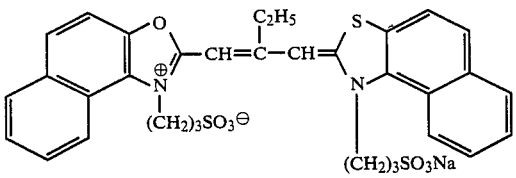
Sensitizing Dye A
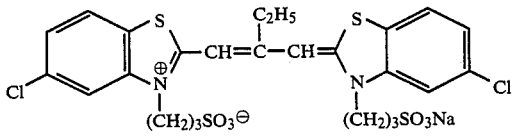
Sensitizing Dye B
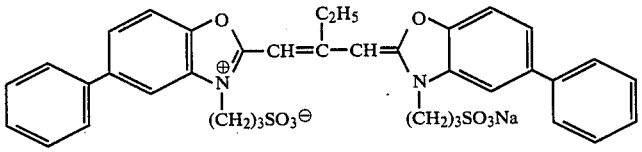
Sensitizing Dye C
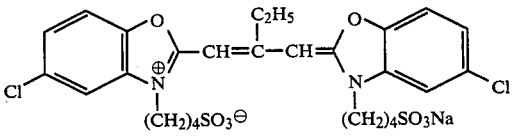
Sensitizing Dye D
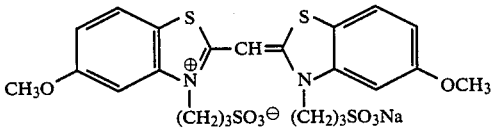
Sensitizing Dye E
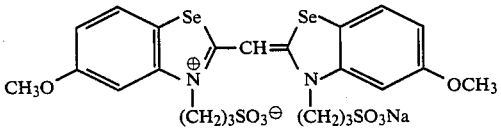
Sensitizing Dye F
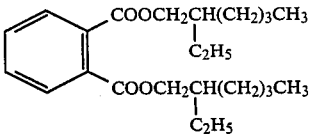
Oil-4
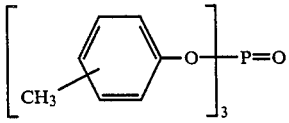
Oil-5
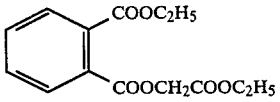
Oil-6
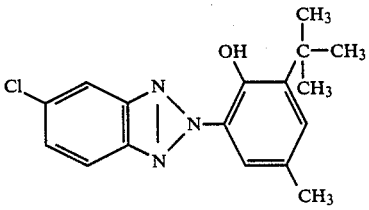
UV-3

-continued

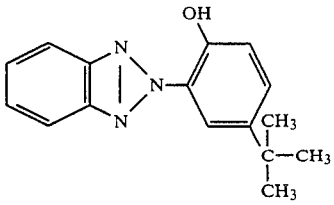

UV-4

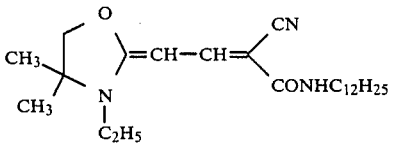

UV-5

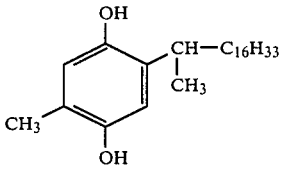

Cpd C $CH_2{=}CHSO_2(CH_2)_3SO_2CH{=}CH_2$

H-2

The samples thus-prepared were subjected to a running processing using the same procedure as described in Example 1 using Processing Step (III). Then each sample was exposed at 20 CMS and processed. The amount of remaining silver was measured. The results thus-obtained are shown in Table 2 below.

Comparative Coupler E

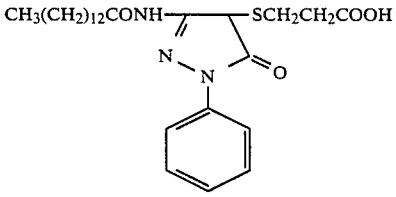

(described in Japanese Patent Application (OPI) No. 201247/86)

Comparative Coupler F

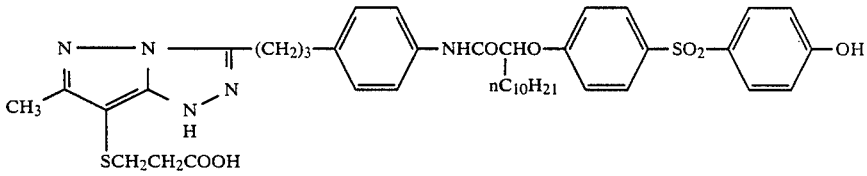

(described in Japanese Patent Application (OPI) No. 201247/86)

TABLE 2

| Sample No. | Coupler Used in Third Layer and Fourth Layer | Coupler Used in Sixth Layer and Seventh Layer | Amount of Remaining Silver Processing Step (III) ($mg/m^2$) |
|---|---|---|---|
| 201 (Control) | Coupler D-1 | D-6 | 47 |
| 202 (Comparison) | Comparative Coupler A | " | 32 |
| 203 (Comparison) | Comparative Coupler B | " | 34 |
| 204 (Comparison) | Comparative Coupler C | " | 35 |
| 205 (Comparison) | Comparative Coupler D | " | 30 |
| 206 (Present Invention) | Compound (2) | " | 16 |
| 207 | Compound | " | 16 |

TABLE 2-continued

| Sample No. | Coupler Used in Third Layer and Fourth Layer | Coupler Used in Sixth Layer and Seventh Layer | Amount of Remaining Silver Processing Step (III) ($mg/m^2$) |
|---|---|---|---|
| (Present Invention) | (3) | | |
| 208 (Present Invention) | Compound (17) | " | 15 |
| 209 (Present Invention) | Compound (21) | " | 18 |
| 210 (Present Invention) | Compound (22) | " | 18 |
| 211 (Comparison) | Coupler D-1 | E | 32 |
| 212 (Comparison) | Coupler D-1 | F | 35 |
| 213 Present Invention) | Coupler D-1 | (12) | 25 |
| 214 (Present Invention) | Coupler D-1 | (14) | 24 |
| 215 (Present Invention) | Coupler D-1 | (16) | 22 |

It is apparent from the results shown in Table 2 that the color photographic materials using the couplers according to the present invention exhibit a small amount of silver remaining and a sufficient bleach accelerating effect under a running condition. It can be seen that the amount of silver remaining is within a range which is of no practical problem by using the compound according to the present invention.

EXAMPLE 3

Sample 301:

On a cellulose triacetate film support having a subbing layer, each layer having the composition shown below was coated to prepare a multilayer color photographic material which was designated Sample 301.

| | |
|---|---|
| First Layer: Antihalation Layer | |
| A gelatin layer (dry layer thickness of 2 μm) containing; | |
| Black Colloidal Silver | 0.25 $g/m^2$ |
| Ultraviolet Ray Absorbing Agent UV-6 | 0.04 $g/m^2$ |
| Ultraviolet Ray Absorbing Agent UV-7 | 0.1 $g/m^2$ |
| Ultraviolet Ray Absorbing Agent UV-8 | 0.1 $g/m^2$ |
| High Boiling Point Organic Solvent Oil-2 | 0.01 $ml/m^2$ |
| Second Layer: Intermediate Layer | |
| A gelatin layer (dry layer thickness of 1 μm) Containing; | |
| Compound Cpd D | 0.05 $g/m^2$ |
| Compound I-1 | 0.05 $g/m^2$ |
| High Boiling Point Organic Solvent Oil-1 | 0.05 $ml/m^2$ |
| Third Layer: First Red-Sensitive Emulsion Layer | |
| A gelatin layer (dry layer thickness of 1 μm) containing; | |
| Silver Iodobromide Emulsion (iodide content: 4 mol %, average grain size: 0.3 μm) spectrally sensitized with Sensitizing Dye S-1 and Sensitizing Dye S-2 | 0.5 $g/m^2$ (as silver) |
| Coupler F-1 | 0.2 $g/m^2$ |
| Coupler F-2 | 0.05 $g/m^2$ |

-continued

| | |
|---|---|
| Compound I-2 | $2 \times 10^{-3}$ $g/m^2$ |
| High Boiling Point Organic Solvent Oil-1 | 0.12 $ml/m^2$ |
| Fourth Layer: Second Red-Sensitive Emulsion Layer | |
| A gelatin layer (dry layer thickness of 2.5 μm) containing; | |
| Silver Iodobromide Emulsion (iodide content: 3 mol %, average grain size: 0.6 μm) spectrally sensitized with Sensitizing Dye S-1 and Sensitizing Dye S-2 | 0.8 $g/m^2$ (as silver) |
| Coupler F-1 | 0.55 $g/m^2$ |
| Coupler F-2 | 0.14 $g/m^2$ |
| Compound I-2 | $1 \times 10^{-3}$ $g/m^2$ |
| High Boiling Point Organic Solvent Oil-1 | 0.33 $ml/m^2$ |
| Dye D-1 | 0.02 $g/m^2$ |
| Fifth Layer: Intermediate Layer | |
| A gelatin layer (dry layer thickness of 1 μm) containing; | |
| Compound Cpd D | 0.1 $g/m^2$ |
| High Boiling Point Organic Solvent Oil-1 | 0.1 $ml/m^2$ |
| Dye D-2 | 0.02 $g/m^2$ |
| Sixth Layer: First Green-Sensitive Emulsion Layer | |
| A gelatin layer (dry layer thickness of 1 μm) containing; | |
| Silver Iodobromide Emulsion (iodide content: 4 mol %, average grain size: 0.3 μm) spectrally sensitized with Sensitizing Dye S-3 and Sensitizing Dye S-4 | 0.7 $g/m^2$ (as silver) |
| Coupler F-3 | 0.02 $g/m^2$ |
| Coupler F-5 | 0.10 $g/m^2$ |
| High Boiling Point Organic Solvent Oil-1 | 0.26 $ml/m^2$ |
| Seventh Layer: Second Green-Sensitive Emulsion Layer | |
| A gelatin layer (dry layer thickness of 2.5 μm) containing; | |
| Silver Iodobromide Emulsion (iodide content: 2.5 mol %, average grain size: 0.6 μm) spectrally sensitized with Sensitizing Dye S-3 and Sensitizing Dye S-4 | 0.7 $g/m^2$ (as silver) |
| Coupler F-4 | 0.10 $g/m^2$ |
| Coupler F-5 | 0.10 $g/m^2$ |
| High Boiling Point Organic | 0.05 $ml/m^2$ |

-continued

| | |
|---|---|
| Solvent Oil-2 | |
| Dye D-3 | 0.05 g/m$^2$ |
| Eighth Layer: Intermediate Layer | |
| A gelatin layer (dry layer thickness of 1 μm) containing; | |
| Compound Cpd D | 0.05 g/m$^2$ |
| High Boiling Point Organic Solvent Oil-2 | 0.1 ml/m$^2$ |
| Dye D-4 | 0.01 g/m$^2$ |
| Ninth Layer: Yellow Filter Layer | |
| A gelatin layer (dry layer thickness of 1 μm) containing; | |
| Yellow Colloidal Silver | 0.1 g/m$^2$ |
| Compound Cpd D | 0.02 g/m$^2$ |
| Compound Cpd B (same as described in Example 1) | 0.03 g/m$^2$ |
| High Boiling Point Organic Solvent Oil-1 | 0.04 ml/m$^2$ |
| Tenth Layer: First Blue-Sensitive Emulsion Layer | |
| A gelatin layer (dry layer thickness of 1.5 μm) containing; | |
| Tabular Silver Iodobromide Emulsion (average aspect ratio: 8, iodide content: 2 mol %, average grain size: 0.7 μm) spectrally sensitized with Sensitizing Dye S-5 | 0.6 g/m$^2$ (as silver) |
| Coupler F-6 | 0.1 g/m$^2$ |
| Coupler F-7 | 0.4 g/m$^2$ |
| High Boiling Point Organic Solvent Oil-1 | 0.1 ml/m$^2$ |
| Eleventh Layer: Second Blue-Sensitive Emulsion Layer | |
| A gelatin layer (dry layer thickness of 3 μm) containing; | |
| Tabular Silver Iodobromide Emulsion (average aspect ratio: 12, iodide content: 2 mol %, average grain size: 1.2 μm) spectrally sensitized with Sensitizing Dye S-6 | 1.0 g/m$^2$ (as silver) |
| Coupler F-6 | 0.4 g/m$^2$ |
| Coupler F-8 | 0.8 g/m$^2$ |
| High Boiling Point Organic Solvent Oil-1 | 0.23 ml/m$^2$ |
| Dye D-5 | 0.02 g/m$^2$ |
| Twelfth Layer: First Protective Layer | |
| A gelatin layer (dry layer thickness of 2 μm) containing; | |
| Ultraviolet Ray Absorbing Agent UV-6 | 0.02 g/m$^2$ |
| Ultraviolet Ray Absorbing Agent UV-7 | 0.32 g/m$^2$ |
| Ultraviolet Ray Absorbing Agent UV-8 | 0.03 g/m$^2$ |
| High Boiling Point Organic Solvent Oil-2 | 0.28 ml/m$^2$ |
| Thirteenth Layer: Second Protective Layer | |
| A gelatin layer (dry layer thickness of 2.5 μm) containing | |
| A Surface-fogged, Fine Grain Silver Iodobromide Emulsion (iodide content: 1 mol %, average grain size: 0.06 μm) | 0.1 g/m$^2$ (as silver) |
| Polymethyl Methacrylate Particles (average particle size: 1.5 μm) | 0.1 g/m$^2$ |

Gelatin hardener H-1 (same as described in Example 1) and a surface active agent were incorporated into each of the layers in addition to the above described components.

The compounds employed for the preparation of the sample are illustrated below.

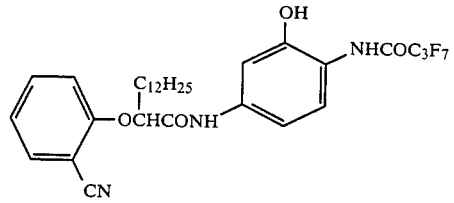

F-1

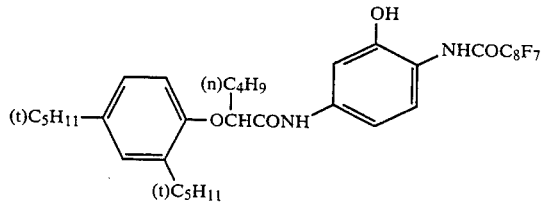

F-2

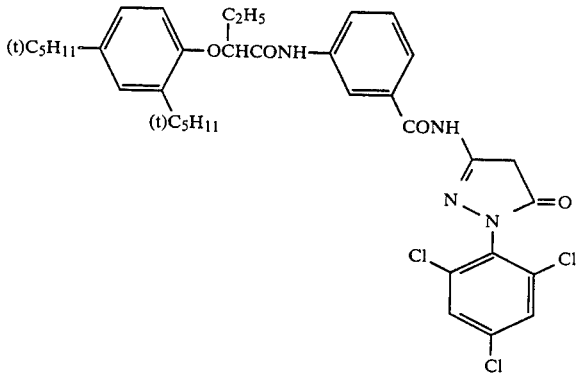

F-3

-continued
F-4
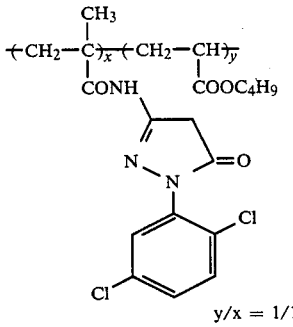
y/x = 1/1 (by weight)
F-5
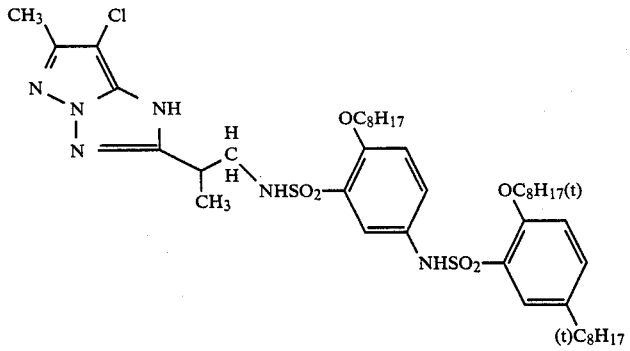
F-6
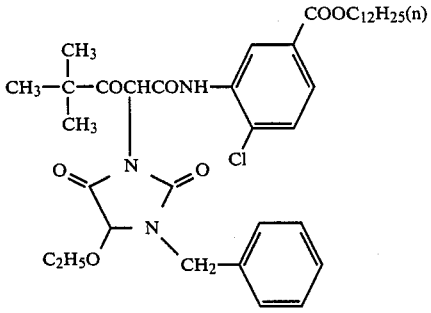
F-7
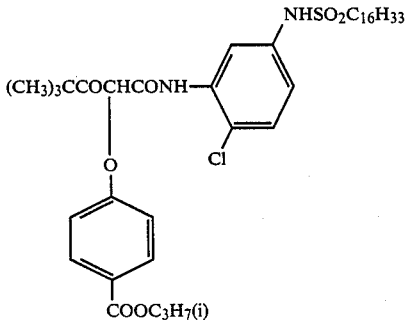

-continued
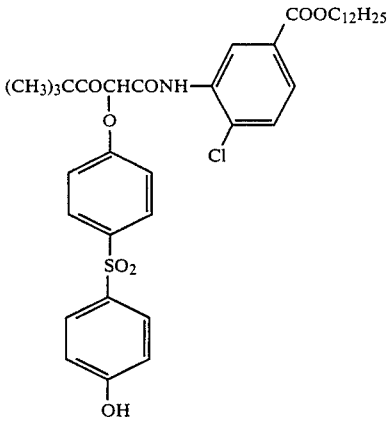
F-8
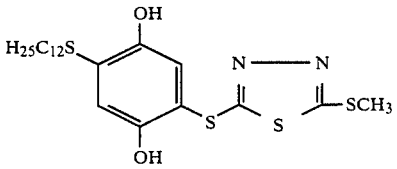
Compound I-1
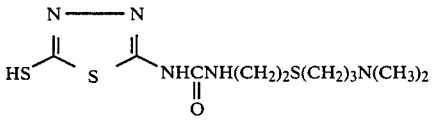
Compound I-2
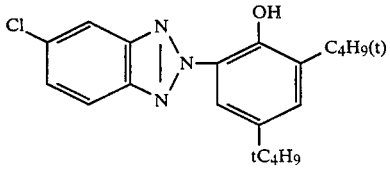
UV-6
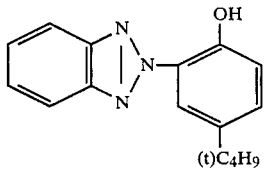
UV-7
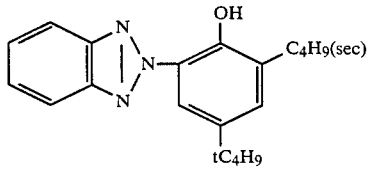
UV-8
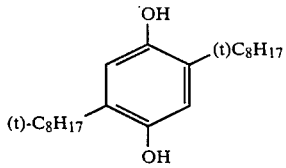
Cpd D
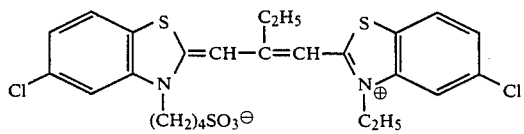
S-1

-continued
S-2
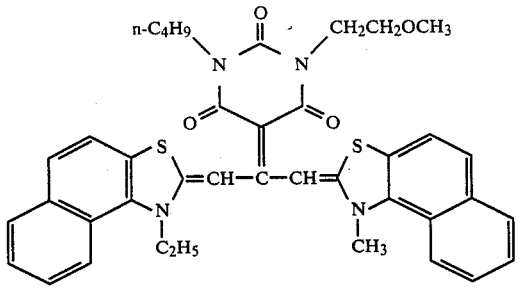
S-3
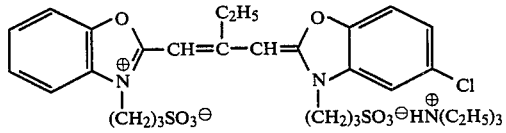
S-4
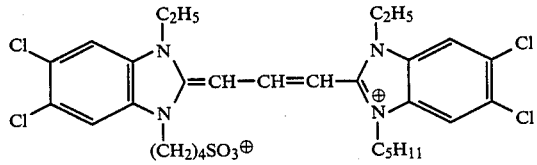
S-5
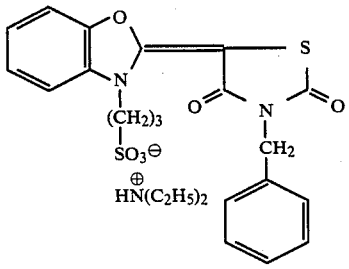
S-6
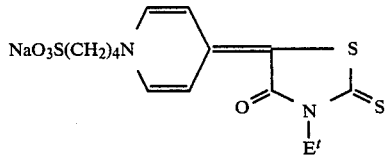
D-1
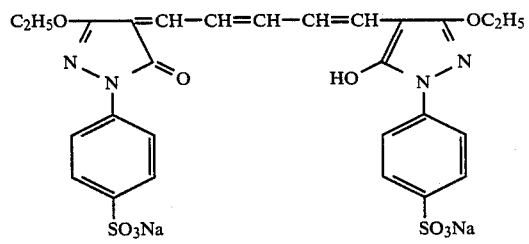
D-2
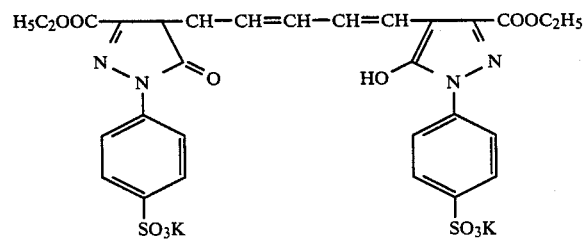

-continued

D-3

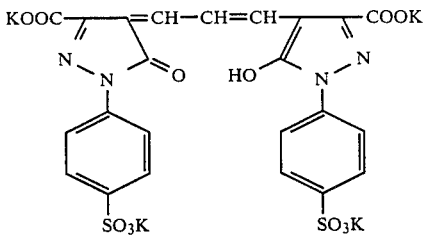

D-4

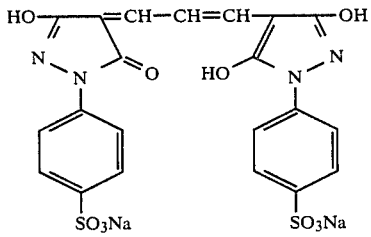

D-5

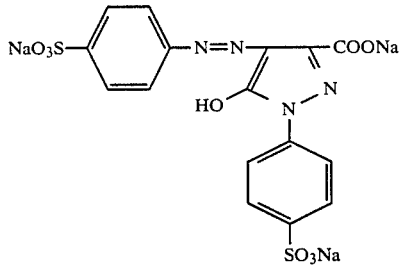

High Boiling Point Organic Solvents Oil-1 and Oil-2 were the same as those employed in Example 1.

Samples 302 to 310:

Samples 302 to 310 were prepared in the same manner as described for Sample 301, except that the total amount of Couplers F-1 and F-2 used in the third layer and the fourth layer was substituted with an equimolar amount of couplers as described in Table 3 shown below, respectively.

The samples thus-prepared were subjected to a running test in the manner as described in Example 1 using the following processing step.

| Step | Temperature | Time (min) | Amount of Replenishment | Capacity of Tank |
|---|---|---|---|---|
| First Development | 38° C. | 6 | 2200 ml | 10 l |
| First Rinse | " | 1 | 2200 ml | 2 l |
| Reversal | " | 1 | 1100 ml | 2 l |
| Second Development | " | 6 | 2200 ml | 10 l |
| Bleaching | " | 2 | 1100 ml | 5 l |
| Bleach-Fixing | " | 3 | 1100 ml | 5 l |
| Washing With Water (1) | 38° C. | 1 | — | 2 l |
| Washing With Water (2) | " | 1 | 1100 ml | 2 l |
| Stabilizing | " | 1 | 1100 ml | 2 l |
| Drying | 60° C. | 2 | — | — |

A replenishment of the water washing bath was conducted using a countercurrent system wherein a replenisher was introduced into Washing With Water (2) and overflow of Washing With Water (2) was introduced into Washing With Water (1). Further, overflow of the bleaching solution was introduced into the bleach-fixing solution.

The composition of each processing solution is illustrated below.

| First Developing Solution: | Tank Solution | Replenisher |
|---|---|---|
| Pentasodium Nitrilo-N,N,N—trimethylenephosphonate | 2.0 g | 2.0 g |
| Sodium Sulfite | 30 g | 30 g |
| Potassium Hydroquinone Monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | — |
| Potassium Thiocyanate | 1.2 g | 1.2 g |
| Potassium Iodide (0.1% solution) | 2 ml | — |
| Water to make | 1,000 ml | 1,000 ml |
| pH | 9.60 | 9.65 |

The pH was adjusted with hydrochloric acid or potassium hydroxide.

| First Rinse Solution: (both Tank Solution and Replenisher) | |
|---|---|
| $KH_2PO_4$ | 6.0 g |
| 5-Sulfosalicylic Acid | 1.5 g |
| Water to make | 1,000 ml |
| pH | 7.0 |

-continued

| Reversal Solution: (both Tank Solution and Replenisher) | |
|---|---|
| Pentasodium Nitrilo-N,N,N—trimethylenephosphonate | 3.0 g |
| Stannous Chloride (dihydrate) | 1.0 g |
| p-Aminophenol | 0.1 g |
| Sodium Hydroxide | 8 g |
| Glacial Acetic Acid | 15 ml |
| Water to make | 1,000 ml |
| pH | 6.0 |

The pH was adjusted with hydrochloric acid or sodium hydroxide.

| Second Developing Solution: | Tank Solution | Replenisher |
|---|---|---|
| Pentasodium Nitrilo-N,N,N—trimethylenephosphonate | 2.0 g | 2.0 g |
| Sodium Sulfite | 7.0 g | 7.0 g |
| Sodium Tertiary Phosphate (12 hydrate) | 36 g | 36 g |
| Potassium Bromide | 1.0 g | 0.3 g |
| Potassium Iodide (0.1% solution) | 90 ml | — |
| Sodium Hydroxide | 3.0 g | 3.0 g |
| Citrazinic Acid | 1.5 g | 1.5 g |
| N—Ethyl-N—(β-methanesulfonamidoethyl)-3-methyl-4-aminoanilino acid salt | 11 g | 11 g |
| 3,6-Dithiaoctan-1,8-diol | 1.0 g | 1.0 g |
| Water to make | 1,000 ml | 1,000 ml |
| pH | 11.80 | 12.05 |

The pH was adjusted with hydrochloric acid or sodium hydroxide.

| Bleaching Solution: (both Tank Solution and Replenisher) | |
|---|---|
| Ammonium Bromide | 100 g |
| Iron (III) Ammonium Ethylenediaminetetraacetate | 120 g |
| Disodium Ethylenediaminetetraacetate | 10.0 g |
| Sodium Nitrate | 10.0 g |
| Water to make | 1,000 ml |
| pH | 6.5 |

| Bleach-Fixing Solution: | Tank Solution | Replenisher |
|---|---|---|
| Ammonium Bromide | 50 g | — |
| Iron (III) Ammonium Ethylenediaminetetraacetate | 60 g | — |
| Disodium ethylenediaminetetraacetate | 5 g | 1.0 g |
| Ammonium Nitrate | 5 g | — |
| Sodium Sulfite | 12.0 g | 20.0 g |
| Sodium Thiosulfate | 240 ml | 400 ml |
| Water to make | 1,000 ml | 1,000 ml |
| pH | 7.3 | 8.0 |
| Washing with Water (1) and (2): (both Mother Solution and Replenisher) | | |

To city water which was passed through a mixed-bed column filled with an H type strongly acidic cation exchange resin (Amberlite IR-120B manufactured by Rohm and Haas Co., Ltd.) and an OH type anion exchange resin (Amberlite IR-400 manufactured by Rohm and Haas Co., Ltd.), and regulated so that calcium ion concentration is 3 mg/liter or less and magnesium ion concentation is 3 mg/liter or less, added 20 mg/liter of sodium isocyanate and 150 mg/liter of sodium sulfate. This water had a pH value of 6.5 to 7.5.

| Stabilizing Solution: | |
|---|---|
| Water | 800 ml |
| Formalin (37 wt % formaldehyde solution) | 5.0 ml |
| Fuji Driwel | 5.0 ml |
| Water to make | 1,000 ml |

With the samples thus-processed, the amount of remaining silver in an unexposed area was measured. The results obtained are shown in Table 3.

TABLE 3

| Sample No. | Coupler Used in Third Layer and Fourth Layer | Amount of Remaining Silver ($mg/m^2$) |
|---|---|---|
| 301 (Control) | Couplers F-1/F-2 | 59 |
| 302 (Comparison) | Comparative Coupler A | 41 |
| 303 (Comparison) | Comparative Coupler B | 39 |
| 304 (Comparison) | Comparative Coupler C | 33 |
| 305 (Comparison) | Comparative Coupler D | 36 |
| 306 (Present Invention) | Compound (2) | 21 |
| 307 (Present Invention) | Compound (3) | 18 |
| 308 (Present Invention) | Compound (17) | 19 |
| 309 (Present Invention) | Compound (21) | 22 |
| 310 (Present Invention) | Compound (22) | 23 |

From the results shown in Table 3 it is apparent that the amount of silver remaining in the samples according to the present invention is within the practically allowable range.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide photographic emulsion layer and comprising a bleach accelerator releasing coupler, wherein said bleach accelerator releasing coupler is represented by formula (I)

$$A\text{—}(TIME)_n\text{—}S\text{—}X\text{-}[(Y)_m\text{—}(Z)]_a \qquad (I)$$

wherein A represents a coupler residual group; TIME represents a timing group; n represents 0 or 1; X represents a cyclic aliphatic group or a saturated heterocyclic group; Y represents an aliphatic group having from 1 to 8 carbon atoms which may contain a group of —O—, a group of —S—, a group of —COO—, a group of —CO—, a group of $$\text{—}\underset{\underset{R_1}{|}}{N}CO\text{—},$$

a group of

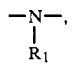

a group of —$SO_2$—, or a group of

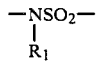

in its chain; m represents an integer of from 0 to 3, and when m represents 2 or more, the two or more Y groups may be the same or different; Z represents a group of —OH, a group of —COOM, a group of —$SO_3M$ or a group of

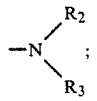

l represents an integer of from 1 to 3, and when l represents 2 or more, the two or more Z groups may be the same or different; a represents 1 or 2, and when a represents 2, the two $(Y)_m$—$(Z)_l$ groups may be the same or different; $R_1$, $R_2$, and $R_3$ each represents a hydrogen atom, or an aliphatic group having from 1 to 4 carbon atoms; and M represents an alkali metal ion, an ammonium ion, or a hydrogen atom.

2. A silver halide photographic material as in claim 1, wherein X represents a saturated or unsaturated cyclic aliphatic group having from 3 to 8 carbon atoms.

3. A silver halide photographic material as in claim 1, wherein X represents a 3-membered to 8-membered saturated heterocyclic group containing, as a hetero atom, at least one of an oxygen atom, a nitrogen atom, and a sulfur atom, and having from 1 to 7 carbon atoms.

4. A silver halide photographic material as in claim 3, wherein the heterocyclic group is derived from a hetero ring selected from an aziridine ring, an oxirane ring, a sulforane ring, a 1,2-oxathiorane ring, a tetrahydrofuran ring, a tetrahydrothiophene ring, an imidazolidine ring, an azetidine ring, a piperidine ring, a 1,3-thiazolidine ring, a morpholine ring, a γ-butyrolactone ring, a pyrrolidine ring, and a 2,4--dioxo-1,3-imidazolidine ring.

5. A silver halide photographic material as in claim 1, wherein the aliphatic group repesented by Y is a straight chain, branched chain or cyclic, saturated or unsaturated aliphatic group.

6. A silver halide photographic material as in claim 1, wherein the coupler residual group represented by A is a yellow coupler residual group, a magenta coupler residual group, a cyan coupler residual group or a non-color forming coupler residual group.

7. A silver halide photographic material as in claim 1, wherein the coupler residual group represented by A is selected from an open-chain ketomethylene type coupler residual group, a 5-pyrazolone type coupler residual group, a pyrazoloimidazole type coupler residual group, a pyrazolotriazole type coupler residual group, a phenol type coupler residual group, a naphthol type coupler residual group, an indanone type coupler residual group and acetophenone type coupler residual group.

8. A silver halide photographic material as in claim 1, wherein A represents a coupler residue represented by formula (Cp-1), (Cp-2), (Cp-3), (Cp-4), (Cp-5), (Cp-6), (Cp-7), (Cp-8), or (Cp-9)

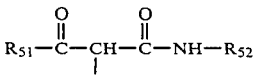
(Cp-1)

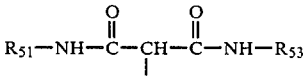
(Cp-2)

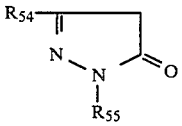
(Cp-3)

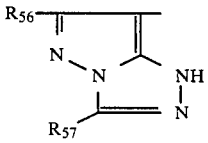
(Cp-4)

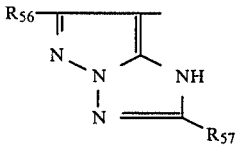
(Cp-5)

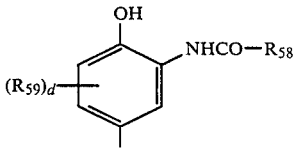
(Cp-6)

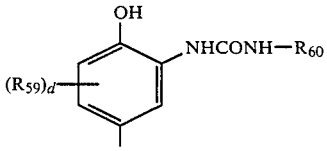
(Cp-7)

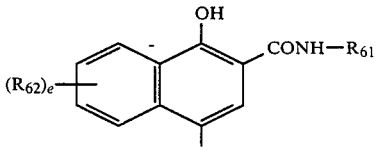
(Cp-8)

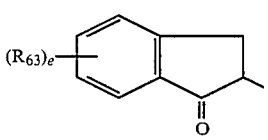
(Cp-9)

wherein $R_{41}$ represents an aliphatic group, an aromatic group or heterocyclic group; $R_{42}$ represents an aromatic group or a heterocyclic group; and $R_{43}$, $R_{44}$, and $R_{45}$ each represents a hydrogen atom, an aliphatic group, an aromatic group, or a heterocyclic group;

$R_{51}$ represents a group as defined for $R_{41}$;

$R_{52}$ and $R_{53}$ each represents a group as defined for $R_{42}$;

$R_{54}$ represents a group as defined for $R_{41}$, a group of $R_{41}CON(R_{43})$—, a group of $R_{41}N(R_{43})$—, a group of $R_{41}SO_2N(R_{43})$—, a group of $R_{41}S$—, a group of $R_{43}O$—, a group of $R_{45}NCON(R_{43})(R_{44})$—, a group of $R_{41}OOC$—, a group of $R_{44}NCO(R_{43})$—, or a group of N≡C—;

$R_{55}$ represents a group as defined for $R_{41}$;

$R_{56}$ and $R_{57}$ each represents a group as defined for $R_{43}$, a group of $R_{41}S$—, a group of $R_{41}O$—, a group of $R_{41}CON(R_{43})$—, a group of $R_{41}N(R_{43})$—, a group of $R_{43}NCON(R_{44})(R_{45})$—, or a group of $R_{41}SO_2N(R_{43})$—;

$R_{58}$ represents a group as defined for $R_{41}$;

$R_{59}$ represents a group as defined for $R_{41}$, a group of $R_{41}N(R_{43})$—, a group of $R_{41}OCON(R_{43})$—, a group of $R_{41}SO_2N(R_{43})$—, a group of $R_{43}NCON(R_{44})(R_{45})$—, a group of $R_{43}NSO_2N(R_{44})(R_{45})$—, a group of $R_{41}O$—, a group of $R_{41}S$—, a halogen atom or a group of $R_{41}N(R_{43})$—;

d represents an integer of from 0 to 3, and when d represents 2 or more, the two or more $R_{59}$ groups may be the same or different, or each of two $R_{59}$'s may be a divalent group and connected with each other to form a cyclic structure;

$R_{60}$ represents a group as defined for $R_{41}$;

$R_{61}$ represents a group as defined for $R_{41}$;

$R_{62}$ represents a group as defined for $R_{41}$, a group of $R_{41}CONH$—, a group of $R_{41}OCONH$—, a group of $R_{41}SO_2NH$—, a group of $R_{43}NCON(R_{44})(R_{45})$—, a group of $R_{43}NSO_2N(R_{44})(R_{45})$—, a group of $R_{43}O$—, a group of $R_{41}S$—, a halogen atom or a group of $R_{41}N(R_{43})$—;

$R_{63}$ represents a group as defined for $R_{41}$, a group of $R_{43}CON(R_{44})$—, a group of $R_{43}NCO-$, (with $R_{44}$)

a group of $R_{41}SO_2N-$, (with $R_{44}$)

a group of $R_{43}NSO_2-$, (with $R_{44}$)

a group of $R_{41}SO_2-$, a group of $R_{43}OCO-$, a group of $R_{43}OSO_2-$, a halogen atom, a nitro group, a cyano group, or a group of $R_{43}CO-$; and e represents an integer from 0 to 4, when e represents 2 or more, the two or more $R_{62}$ groups or $R_{63}$ groups may be the same or different.

9. A silver halide photographic material as in claim 8, wherein a substituent for the aliphatic group, aromatic group or heterocyclic group is selected from a halogen atom, a group of $R_{47}O-$, a group of $R_{46}S-$, a group of $R_{47}CON-$, (with $R_{48}$)

a group of $R_{47}NCO-$, (with $R_{48}$)

a group of $R_{46}OCON-$, (with $R_{47}$)

a group of $R_{46}SO_2N-$, (with $R_{47}$)

a group of $R_{47}NSO_2-$, (with $R_{48}$)

a of group of $R_{46}SO_2-$, a group of $R_{47}OCO-$, a group of $R_{47}NCON-$, (with $R_{48}$ $R_{49}$)

a group of $R_{46}$, a group of

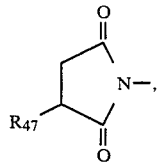

a group of $R_{46}COO-$, a group of $R_{47}OSO_2-$, a cyano group, or a nitro group, wherein $R_{46}$ represents an aliphatic group, an aromatic group, or a heterocyclic group; and $R_{47}$, $R_{48}$ and $R_{49}$ each represents a hydrogen atom, an aliphatic group, an aromatic group or a heterocyclic group.

10. A silver halide photographic material as in claim 8, wherein $R_{51}$ represents an aliphatic group or an aromatic group; $R_{52}$, $R_{53}$, and $R_{55}$ each represents an aromatic group; $R_{54}$ represents a group of $R_{41}CONH-$ or a group of $R_{41}-N-$; (with $R_{43}$)

$R_{56}$ and $R_{57}$ each represents an aliphatic group, a group of $R_{41}O-$, or a group of $R_{41}S-$;

$R_{58}$ represents an aliphatic group or an aromatic group;

$R_{59}$ in formula (Cp-6) represents a chlorine atom, an aliphatic group or a group of $R_{41}CONH-$;

d in formula (Cp-6) represents 1 or 2;

$R_{60}$ represents an aromatic group;

$R_{59}$ in formula (Cp-7) represents a group of $R_{41}CONH-$;

d in formula (Cp-7) represents 1;

$R_{61}$ represents an aliphatic group or an aromatic group;

e in formula (Cp-8) represents 0 or 1;

$R_{62}$ represents a group of $R_{41}OCONH-$, a group of $R_{41}CONH-$, or a group of $R_{41}SO_2NH-$; and $R_{63}$ represents a group of $R_{41}CONH-$, a group of $R_{41}SO_2NH-$, a group of $R_{44}NSO_2$, (with $R_{43}$)

a group of $R_{41}SO_2-$, a group of $R_{44}NCO-$, (with $R_{43}$)

a nitro group or a cyano group.

11. A silver halide photographic material as in claim 1, wherein the group represented by TIME is a group represented by formula (T-1)

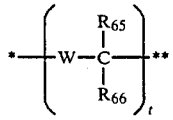

(T-1)

wherein the bond indicated by * denotes the position at which the group is connected to the left side group in formula (I); the bond indicated by ** denotes the position at which the group is connected to the right side group in formula (I); W represents an oxygen atom, a sulfur atom, or a group of

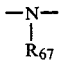

(wherein $R_{67}$ represents an acyl group, a sulfonyl group or a sulfamoyl group or $R_{67}$ may represent a divalent group connected with $R_{65}$ or $R_{66}$ to form a heterocyclic ring); $R_{65}$ and $R_{66}$ each, represents a hydrogen atom, an alkyl group, an aryl group or a heterocyclic ring group or $R_{65}$ and $R_{66}$ may represent a divalent group connected with each other to form a carbon ring or a heterocyclic ring; t represents 1 or 2, and when t represents 2, the two

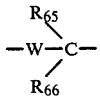

groups may be the same or different; and any two of $R_{65}$, $R_{66}$, and $R_{67}$; may be connected to each other to form a cyclic structure.

12. A silver halide photographic material as in claim 1, wherein the group represented by TIME is a group represented by formula (T-2)

*—Nu—Link—E—** (T-2)

wherein the bond indicated by * denotes the position at which the group is connected to the left side group in formula (I); the bond indicated by  denotes the position at which the group is connected to the right side group in formula (I); Nu represents a nucleophilic group; E represents an electrophilic group which is able to cleave the bond indicated by  upon a nucleophilic attack of Nu; and Link represents a linking group which connects Nu with E in a stereochemical position capable of causing an intramolecular nucleophilic displacement reaction between Nu and E.

13. A silver halide photographic material as in claim 1, wherein the group represented by TIME is a group represented by formula (T-3)

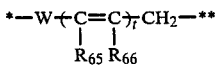

wherein the bond indicated by * denotes the position at which the group is connected to the left side group in formula (I); the bond indicated by ** denotes the position at which the group is connected to the right side group in formula (I); W represents an oxygen atom, a sulfur atom or a group of

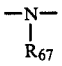

(wherein $R_{67}$ represents an acyl group, a sulfonyl group or a sulfamoyl group or $R_{67}$ may represent a divalent group connected with $R_{65}$ or $R_{66}$ to form a heterocyclic ring); $R_{65}$ and $R_{66}$ each represents a hydrogen atom, an alkyl group, an aryl group or a heterocyclic ring group or $R_{65}$ and $R_{66}$ may represent a divalent group connected with each other to form a carbon ring or a heterocyclic ring; t represents 1 or 2, and, when t represents 2, the two

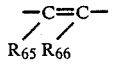

groups may be the same or different; and $R_{65}$ and $R_{66}$ may be connected to each other to form a cyclic structure.

14. A silver halide photographic material as in claim 1, wherein the group represented by TIME is a group represented by formula (T-4) or (T-5)

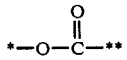

(T-4)

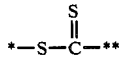

(T-5)

wherein the bond indicated by * denotes the position at which the group is connected to the left side group in formula (I); and the bond indicated by ** denotes the position at which the group is connected to the right side group in formula (I).

15. A silver halide photographic material as in claim 1, wherein the group represented by TIME is a group represented by formula (T-6)

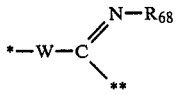

wherein the bond indicated by * denotes the position at which the group is connected to the left side group in formula (I); the bond indicated by ** denotes the position at which the group is connected to the right side group in formula (I); W represents an oxygen atom, a sulfur atom, or a group of

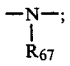

and $R_{67}$ and $R_{68}$ each represents an acyl group, a sulfonyl group, or a sulfamoyl group.

16. A silver halide photographic material as in claim 1, wherein the bleach accelerator-releasing coupler is present in a silver halide emulsion layer or a light-insensitive intermediate layer.

17. A silver halide photographic material as in claim 1, wherein an amount of the bleach accelerator-releasing coupler is from 0.1 mol % to 50 mol % based on the total coating amount of silver.

18. A silver halide photographic material as in claim 1, wherein the photographic material comprises at least one blue-sensitive silver halide emulsion layer containing at least one yellow color forming coupler, at least one green-sensitive silver halide emulsion layer containing at least one magenta color forming coupler and at least one red-sensitive silver halide emulsion layer containing at least one cyan color forming coupler.

19. A method for processing a silver halide photographic material as in claim 1, wherein the photographic material is not subjected, between the color developing step and the bleach-fixing step, to a water washing step.

20. A method for processing a silver halide photographic material as in claim 19, wherein the photographic material is subjected, after the bleach-fixing processing, to a water washing step and/or a stabilizing step.

* * * * *